US008644527B2

(12) United States Patent
Fujise et al.

(10) Patent No.: US 8,644,527 B2
(45) Date of Patent: Feb. 4, 2014

(54) PIEZOELECTRIC ACOUSTIC TRANSDUCER

(75) Inventors: Akiko Fujise, Osaka (JP); Toshiyuki Matsumura, Osaka (JP); Kazue Satoh, Osaka (JP)

(73) Assignee: Panasonic Corporation, Osaka (JP)

( * ) Notice: Subject to any disclaimer, the term of this patent is extended or adjusted under 35 U.S.C. 154(b) by 595 days.

(21) Appl. No.: 12/526,986

(22) PCT Filed: Dec. 19, 2008

(86) PCT No.: PCT/JP2008/003863

§ 371 (c)(1),
(2), (4) Date: Aug. 13, 2009

(87) PCT Pub. No.: WO2009/078184

PCT Pub. Date: Jun. 25, 2009

(65) Prior Publication Data

US 2010/0061573 A1 Mar. 11, 2010

(30) Foreign Application Priority Data

Dec. 19, 2007 (JP) ..... 2007-326898

(51) Int. Cl.
*H04R 25/00* (2006.01)

(52) U.S. Cl.
USPC ..... 381/173; 381/190; 381/114

(58) Field of Classification Search
USPC ..... 381/190, 114, 173; 310/324, 334
See application file for complete search history.

(56) References Cited

U.S. PATENT DOCUMENTS 4,170,742 A * 10/1979 Itagaki et al. ..... 310/324
4,900,602 A * 2/1990 Kawakami et al. ..... 428/76
5,233,256 A * 8/1993 Hayashi et al. ..... 310/317
6,332,029 B1 * 12/2001 Azima et al. ..... 381/152
6,747,395 B1 6/2004 Satoh et al.
6,865,785 B2 * 3/2005 Ogura et al. ..... 29/25.35
2008/0218031 A1 9/2008 Kuroda et al.

FOREIGN PATENT DOCUMENTS

JP 62-213398 9/1987
JP 5-41297 6/1993
JP 2001-016692 1/2001
JP 2001-86592 3/2001

(Continued)

OTHER PUBLICATIONS

International Search Report issued Apr. 7, 2009 in International (PCT) Application No. PCT/JP2008/003863, filed Dec. 19, 2008.

*Primary Examiner* — Davetta W Goins
*Assistant Examiner* — Amir Etesam
(74) *Attorney, Agent, or Firm* — Wenderoth, Lind & Ponack, L.L.P.

(57) ABSTRACT

A piezoelectric acoustic transducer achieves both space-saving and high sound quality without increasing the number of parts. In order to achieve this, the transducer includes a piezoelectric element constructed of a piezoelectric material interposed between two surface electrodes and a diaphragm of which at least one principal surface is provided with a print wiring and at least one principal surface is bonded to the piezoelectric element. The diaphragm includes a frame section, a vibrating section which is bonded with the piezoelectric element and which vibrates, and at least one supporting section which connects the frame section and the vibrating section and which supports the vibrating section. Either the frame section or the at least one supporting section includes at least one electrical resistance which is integrally formed to the print wiring and which constructs, in combination with the piezoelectric element, a series-RC circuit.

15 Claims, 24 Drawing Sheets

(56) References Cited

FOREIGN PATENT DOCUMENTS

| | | |
|---|---|---|
| JP | 2001-275190 | 10/2001 |
| JP | 2002-342321 | 11/2002 |
| JP | 2003-230193 | 8/2003 |
| JP | 2004-023436 | 1/2004 |
| WO | 2007/060768 | 5/2007 |

* cited by examiner (LOWER SURFACE SIDE OF DIAPHRAGM IS OMITTED)

PIEZOELECTRIC ACOUSTIC TRANSDUCER

TECHNICAL FIELD

The present invention relates to a piezoelectric acoustic transducer, and more specifically, relates to a piezoelectric acoustic transducer that achieves both space-saving and high sound quality.

BACKGROUND ART

In recent years, the trend toward thinner and smaller mobile phones and other mobile instruments has been accelerating; and in addition, the need for thinner and smaller parts mounted in audio-visual instruments and the like has also been increasing.

As a method for driving a loudspeaker that plays a ring tone or a music signal with a mobile phone and the like, an electrodynamic type has been used conventionally. However, when the electrodynamic type is used, due to the structure thereof, it is inherently difficult to reduce the thickness of a loudspeaker; and when reduction in thickness is attempted, there are problems such as: deterioration of low-frequency sound pressure, necessity for measures to prevent magnetic leak due to the use of a magnetic circuit, and the like.

On the other hand, a piezoelectric type loudspeaker, which has been widely used in an electric appliance or an information instrument for playing audios, is attracting attention as a driving method suited for reducing thickness; and there are increasing number of examples in which the piezoelectric type loudspeaker is mounted in a mobile phone or a small size information terminal.

Conventionally, the piezoelectric type loudspeaker is known as an acoustic transducer that uses a piezoelectric material as an electric acoustic transduction element, and is used as acoustics outputting means for small size instruments (e.g., refer patent document 1).

The piezoelectric type loudspeaker has a configuration in which a piezoelectric element is bonded to a metal plate or the like. For this reason, it is easy to reduce the thickness of the piezoelectric type loudspeaker compared to an electrodynamic loudspeaker that requires a magnet and a voice coil, thereby the piezoelectric type loudspeaker has an advantage of not requiring measures to prevent magnetic leak.

When using the piezoelectric type loudspeaker for playing an audio, it is necessary to pay attention to the following properties.

First, while a speed of a diaphragm is proportional to a voltage in the electrodynamic loudspeaker, in the piezoelectric type loudspeaker, a diaphragm displacement is basically proportional to the voltage. Therefore, the characteristic of the sound pressure of the piezoelectric type loudspeaker during constant voltage driving is a characteristic in which sound pressure level increases as the frequency increases (a characteristic of a constant increase). This sound pressure characteristic is different from a flat frequency characteristic that is generally required for a loudspeaker.

Second, while an electric impedance of the electrodynamic loudspeaker may be considered to be nearly at a constant value regardless of the frequency, an electric impedance of the piezoelectric type loudspeaker reduces inverse proportionally to the frequency, since a piezoelectric element part operates as a capacitor. For this reason, the piezoelectric type loudspeaker has a danger of short-circuiting due to an overcurrent at a high frequency range.

In order to deal with the above described properties, when designing the piezoelectric type loudspeaker, an electrical resistance is normally connected to the piezoelectric element in series to form an RC circuit, allowing an electric current to flow through an electrically resistive part at the high frequency range. This enables suppression of a high frequency range input to the piezoelectric loudspeaker, which is also a capacitor; and allows obtaining desired sound pressure characteristic and electric characteristic.

FIG. 25 is a figure with measurement data showing a sound pressure suppressing effect at the high frequency range when the electrical resistance is connected to the piezoelectric element in series with a bimorph type piezoelectric loudspeaker. The capacitance per one surface of the bimorph type piezoelectric loudspeaker is 210 nF; and the electrical resistance, which is connected to the piezoelectric element in series, is 220Ω. As obvious from FIG. 25, when compared to a case of having only the piezoelectric element itself (a case without the electrical resistance), a case where the electrical resistance is connected to the piezoelectric element in series (a case with the electrical resistance) shows increased electric impedance at the high frequency range, and flat sound pressure characteristic.

Furthermore, the piezoelectric type loudspeaker causes performance deterioration of the piezoelectric material due to reduction in the capacitance by a pyroelectric effect, when used at a condition where temperature shifts extensively. In order to avoid this, there are conventional arts in which an electrical resistance is parallelly connected to the piezoelectric type loudspeaker (e.g., refer patent document 2).

Patent Document 1: Japanese Laid-Open Patent Publication No. 2003-230193

Patent Document 2: Japanese Laid-Open Patent Publication No. 2001-275190

SUMMARY OF THE INVENTION

Problems to be Solved by the Invention

However, when additional electrical resistances are connected, as in the conventional arts described above, it normally results in an increase in the number of parts, which leads to an increase in the manufacturing cost. Furthermore, one of the advantages of the piezoelectric type loudspeaker, that is, space-saving is lost. This is specifically described in the following.

FIG. 26 is a figure showing a conventional piezoelectric type loudspeaker 1000 described in patent document 1. As shown in FIG. 26, the conventional piezoelectric type loudspeaker 1000 includes a substrate 1020 to form an RC circuit on an outer side of a frame 1010. According to this method of configuration, the piezoelectric type loudspeaker's advantage of being thin is intact. However, with this method, it is necessary for a space to form the substrate 1020 on the outer side of the frame 1010 of the piezoelectric type loudspeaker.

Furthermore, generally with a small size loudspeaker, it is difficult to play a low pitch sound with high sound quality. Additionally, generally with the piezoelectric type loudspeaker, because of the driving principle of the piezoelectric type loudspeaker, peaks/dips in the frequency characteristic is prone to occur due to a vibrational mode of a diaphragm mechanism. As described above, there are problems in attaining high sound quality with the piezoelectric type loudspeaker.

Therefore, the objective of the present invention is to provide a piezoelectric type loudspeaker that achieves both space-saving and high sound quality without increasing the number of parts.

Solution to the Problems

The present invention is directed toward a piezoelectric acoustic transducer that produces sounds by using a piezoelectric material which deforms depending on an applied voltage. In order to achieve the objective described above, the piezoelectric acoustic transducer of the present invention includes: a piezoelectric element constructed of the piezoelectric material interposed between two surface electrodes; and a diaphragm of which at least one principal surface is provided with a print wiring and at least one principal surface is bonded to the piezoelectric element, and the diaphragm includes: a frame section; a vibrating section which is bonded with the piezoelectric element, and which vibrates; and at least one supporting section which connects the frame section and the vibrating section, and which supports the vibrating section, and the frame section and/or the at least one supporting section include at least one electrical resistance which is integrally formed to the print wiring, and which constructs, in combination with the piezoelectric element, a series-RC circuit.

Furthermore, the piezoelectric element preferably functions as a plurality of capacitors parallelly connected by having at least one of the two surface electrodes split; and the at least one electrical resistance forms at least one series-RC circuit in combination with at least one of the plurality of capacitors.

Furthermore, the piezoelectric element preferably functions as a plurality of capacitors parallelly connected by having the two surface electrode split, and at least one vibrational mode specific to the vibrating section bonded to the piezoelectric element is cancelled by having a voltage with reverse polarity applied to at least one of the plurality of capacitors.

Furthermore, the at least one series-RC circuit preferably forms an electrical equalizer.

Furthermore, the at least one series-RC circuit is preferably configured such that frequency ranges of sounds produced in each area of the vibrating section are different from each other.

Furthermore, the two surface electrodes that sandwich the piezoelectric material may have a part that is absent of an electrode.

Furthermore, preferably, a highly flexible filler that fills gaps among the frame section and the vibrating section, is further included.

Furthermore, the at least one electrical resistance is formed from either an alloy, a resin, or a composite material of a metal and a resin.

Furthermore, the at least one electrical resistance may be covered with a material having a high heat dissipating ability.

Furthermore, the at least one electrical resistance may be formed on a material having a high thermal insulation property.

Furthermore, the piezoelectric material is composed of either a single crystal piezoelectric body, a ceramic piezoelectric body, or a high molecule piezoelectric body.

The print wiring may be further integrally formed with a thin film capacitor that regulates characteristics of the series-RC circuit.

Furthermore, the at least one electrical resistance may be composed of a material having a higher electrical resistance value than the print wiring.

Furthermore, the at least one electrical resistance may be formed as a result of a shape of the print wiring.

Furthermore, the at least one electrical resistance may be formed as a result of having one part of the print wiring formed in a thin line form.

Furthermore, the at least one electrical resistance may be formed as a result of having a reduced layer thickness of the print wiring.

Effect of the Invention

According to the present invention described above, a resistance, which is connected in series with a piezoelectric element and which has a property of a capacitor, is integrally formed to one part of an electrode formed on a diaphragm surface by using a printing technology and the like. By this, it is possible to flatten a sound pressure characteristic without increasing the number of parts, and in addition, attain space-saving. Furthermore, according to the present invention, supporting a vibrating section with a supporting section allows the vibrating section to vibrate easily at low frequency. By this, it is possible to play a low pitch sound with high sound quality. As a result, according to the present invention, a piezoelectric type loudspeaker, which achieves both space-saving and high sound quality without increasing the number of parts, can be provided.

DESCRIPTION OF THE REFERENCE CHARACTERS

Figure 1:
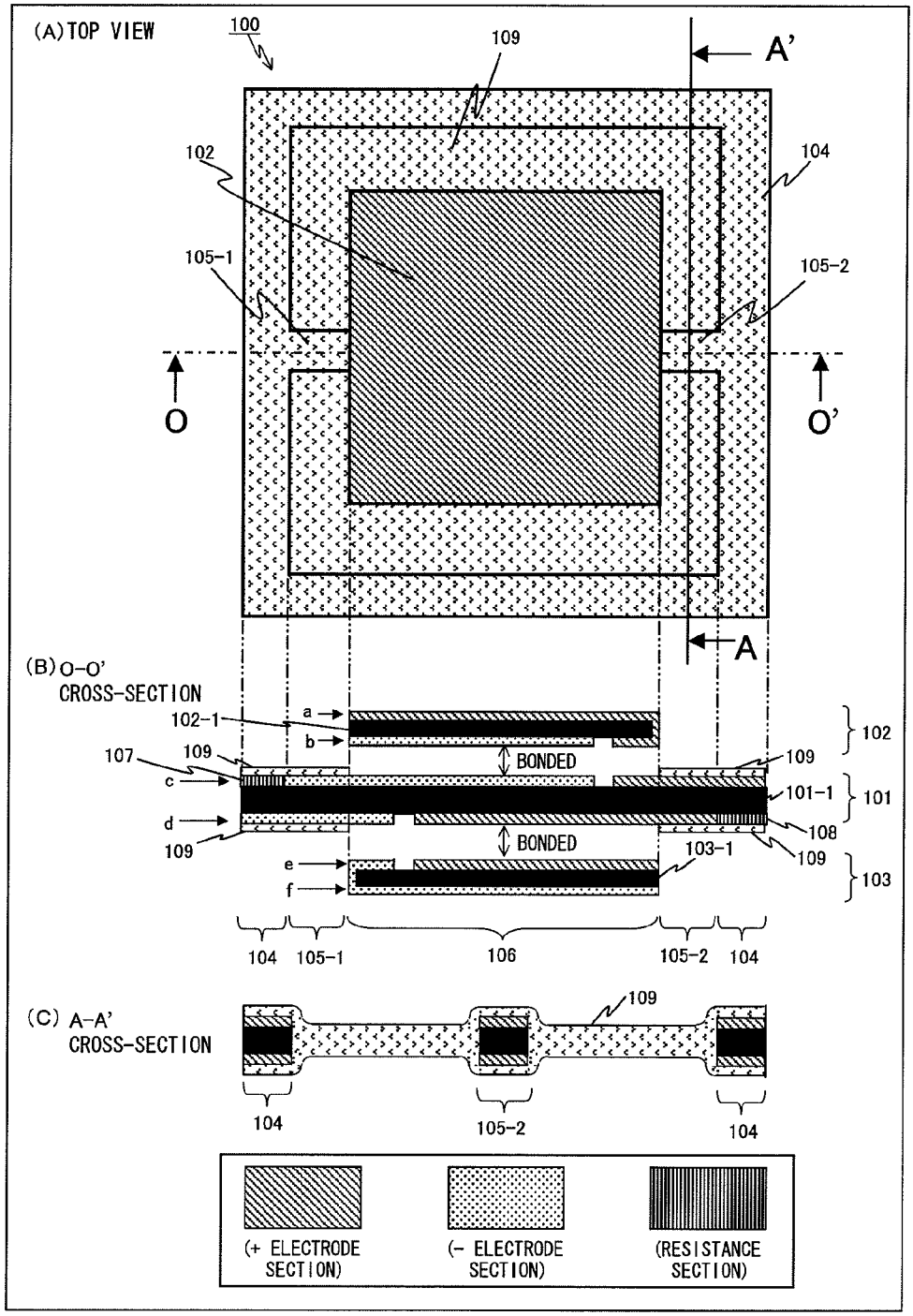
FIG. 1 is a top view and cross sectional views of one example of a piezoelectric type loudspeaker 100 according to a first embodiment of the present invention.

36, 43, 51 chassis
37, 44, 52 display
38, 45, 53, 100, 200, 300, 400, 500, 600, 700, 1000 piezoelectric type loudspeaker
39, 46 sound hole
101, 201, 301, 401, 501, 601, 701 diaphragm
101-1, 201-1, 301-1, 401-1, 501-1, 601-1, 701-1, 1020 substrate
102, 103, 202, 203, 302, 303, 402, 403, 502, 503, 602, 603, 702, 703 piezoelectric element
102-1, 103-1, 202-1, 203-1, 302-1, 402-1, 502-1, 602-1, 702-1 piezoelectric material
109, 209, 709 filler
104, 204, 304, 404, 504, 604, 704 frame section
105-1, 105-2, 205-1 to 205-4, 305-1 to 305-4, 705-1, 705-2 supporting section
106, 206, 406, 706 vibrating section
107, 108, 207, 208, 307, 407, 408, 507, 508, 607, 707, 708, 707-1, 707-2, 708-1, 708-2 resistance section (resistance)
110 alternating-current power supply
111, 112, 211, 212, 311 to 313, 411, 511 to 513, 611 to 613, 711 to 713 capacitor
440 heat dissipating material
430 thermal insulation material
550 wiring electrode
1010 frame
a, b, c, d, e, f electrode layer
a-1 to a-3, b-1 to b-4, c-1 to c-4, d-1, e-1, e-2, f-1 electrode

DETAILED DESCRIPTION OF THE INVENTION

Before describing specifics of a piezoelectric type loudspeaker according to each embodiment of the present invention, characteristics of the following configurational elements that will be described in each embodiment are described all together.

A piezoelectric material is a material having piezoelectric ability and deforms depending on an applied voltage; and a single crystal piezoelectric body, a ceramic piezoelectric body, and a high molecule piezoelectric body, can be listed as examples. An electrode layer is composed of a conductive material such as a metal and the like. The electrode layer is composed, for example, of: a thin film material that includes either copper, aluminum, titanium, silver, or the like; and an thin film material composed of an alloy of those. A substrate is a material having an insulation characteristic, such as a generic plastic material (polycarbonate, polyarylate film, polyethylene terephthalate, and the like), a rubber based high molecule material (SBR, NBR, acrylonitrile, and the like), a liquid crystal polymer, and the like.

A piezoelectric type loudspeaker according to each embodiment of the present invention is described specifically in the following with reference to the drawings.

First Embodiment

FIG. 1 is a top view and cross sectional views of one example of a piezoelectric type loudspeaker 100 according to a first embodiment. In FIG. 1, (A) is the top view, (B) is a cross-sectional view of O-O', and (C) is a cross-sectional view of A-A'. As shown in (A) to (C) of FIG. 1, the piezoelectric type loudspeaker 100 includes a diaphragm 101, a piezoelectric element 102, a piezoelectric element 103, and a filler 109. In (B) of FIG. 1, the diaphragm 101, the piezoelectric element 102, and the piezoelectric element 103 are illustrated separately for convenience of description; however, in practice, the diaphragm 101, the piezoelectric element 102, and the piezoelectric element 103 are bonded to each other.

The piezoelectric element 102 includes: a piezoelectric material 102-1; an electrode layer a which is formed on the upper surface of the piezoelectric material 102-1; and an electrode layer b which is formed on the lower surface of the piezoelectric material 102-1 (refer (B) of FIG. 1). Similarly, the piezoelectric element 103 includes: a piezoelectric material 103-1; an electrode layer e which is formed on the upper surface of the piezoelectric material 103-1; and an electrode layer f which is formed on the lower surface of the piezoelectric material 103-1. The piezoelectric element 102 generates vibration by creating an electric field between the electrode layer a and the electrode layer b, and deforming the piezoelectric material 102-1. Similarly, the piezoelectric element 103 generates vibration by creating an electric field between the electrode layer e and the electrode layer f, and deforming the piezoelectric material 103-1.

The diaphragm 101 includes: a substrate 101-1; an electrode layer c which is formed on the upper surface of the substrate 101-1; and an electrode layer d which is form on the lower surface of the substrate 101-1 (refer (B) of FIG. 1). When classified functionally, the diaphragm 101 includes: a frame section 104, a supporting section 105-1, a supporting section 105-2, and a vibrating section 106 (refer (A) and (B) of FIG. 1). The frame section 104 is a part that is fixed to a partner device when the piezoelectric type loudspeaker 100 is mounted. The frame section 104 is positioned, for example, at an outer circumferential part of the diaphragm 101 in a strip-shaped form. The vibrating section 106 generates sound, by vibrating due to the effect of having the piezoelectric element 102 bonded to the upper surface, and the piezoelectric element 103 bonded to the lower surface. For this reason, it is preferred if the shape and size of the vibrating section 106, when the substrate 101-1 is viewed from the upper surface, are identical to those of the piezoelectric element 102 and the piezoelectric element 103. The supporting section 105-1 and the supporting section 105-2 support the vibrating section 106 by linking the frame section 104 and the vibrating section 106. Furthermore, the supporting section 105-1 and the supporting section 105-2 electrically connect the frame section 104 and the vibrating section 106 by means of electrode layers formed on the upper surfaces and the lower surfaces of the supporting section 105-1 and the supporting section 105-2. As a footnote, the electrode layers are not formed on the supporting section 105-1 and the supporting section 105-2, when a wiring design that does not require an electrode layer is adopted. In the diaphragm 101, the frame section 104, the supporting section 105-1, the supporting section 105-2, and the vibrating section 106 are formed by punch processing a substrate material having the electrode layers formed thereon.

The filler 109 fills gaps among the frame section 104, the supporting section 105-1, the supporting section 105-2, and the vibrating section 106. Furthermore, the filler 109 is also provided on the surfaces of the frame section 104, the supporting section 105-1, and the supporting section 105-2 (refer (A) to (C) of FIG. 1). The filler 109 consists of a material which has high flexibility and high heat conductivity; and which is represented by a material obtained by adding a high heat conductive material to a laminating material, and a material obtained by layering a high heat conductive material and a laminating material. By filling gaps among the diaphragm 101 using the filler 109, it is possible to prevent a sound generated at the back surface of the diaphragm 101 (opposite phase sound) from spreading to the front surface of the diaphragm 101 through the gaps of the diaphragm 101 and prevent reduction of sound pressure at low frequency range. Specifically, a laminating material is a generic plastic material (polyethylene terephthalate and the like), a rubber based high molecule material (SBR, NBR, acrylonitrile, and the like), and the like. Furthermore, a high heat conductive material is metal (copper, aluminum, and the like), silica, and the like. It is necessary for the filler 109 to have an electrical insulation characteristic. Therefore, when the filler 109 consists of a material obtained by layering a laminating material and a metal, for example, a metal layer is formed internally of the filler 109. In addition, when the filler 109 is consisted of a material obtained by adding a metal to a laminating material, for example, it is preferred if any one of the following methods are used. A first method is a method in which, a surface of a metal particle is coated with an insulation material (silica, fluorine resin, and the like) prior to being added. A second method is a method that uses, as a laminating material, a material that has, while in a liquefaction state, a high wettability against a surface of a metal particle that is intended to be added. According to the first and the second methods, added metal particles are isolated from each other, and the added metal particles can be prevented from being expose on a surface of the filler 109. A third method is a method in which a thin film layer constructed of an insulation material is provided in between the electrode layers of the diaphragm 101 and the filler 109. According to the third method, the added metal can be prevented from being exposed on the surface of the filler 109. By using the above described methods, the filler 109 can obtain an electrical insulation characteristic even when a metal is included. The fillers in later described embodiments, from a second embodiment and beyond, also have the same characteristic.

As shown in FIG. 1, in each of the electrode layers, a plus side electrode part (hereinafter, referred to as a + electrode section), a minus side electrode part (hereinafter, referred to as a – electrode section), and an electrically resistive part (hereinafter, referred to as a resistance section), are all graphically represented with different patterns.

Figure 2:
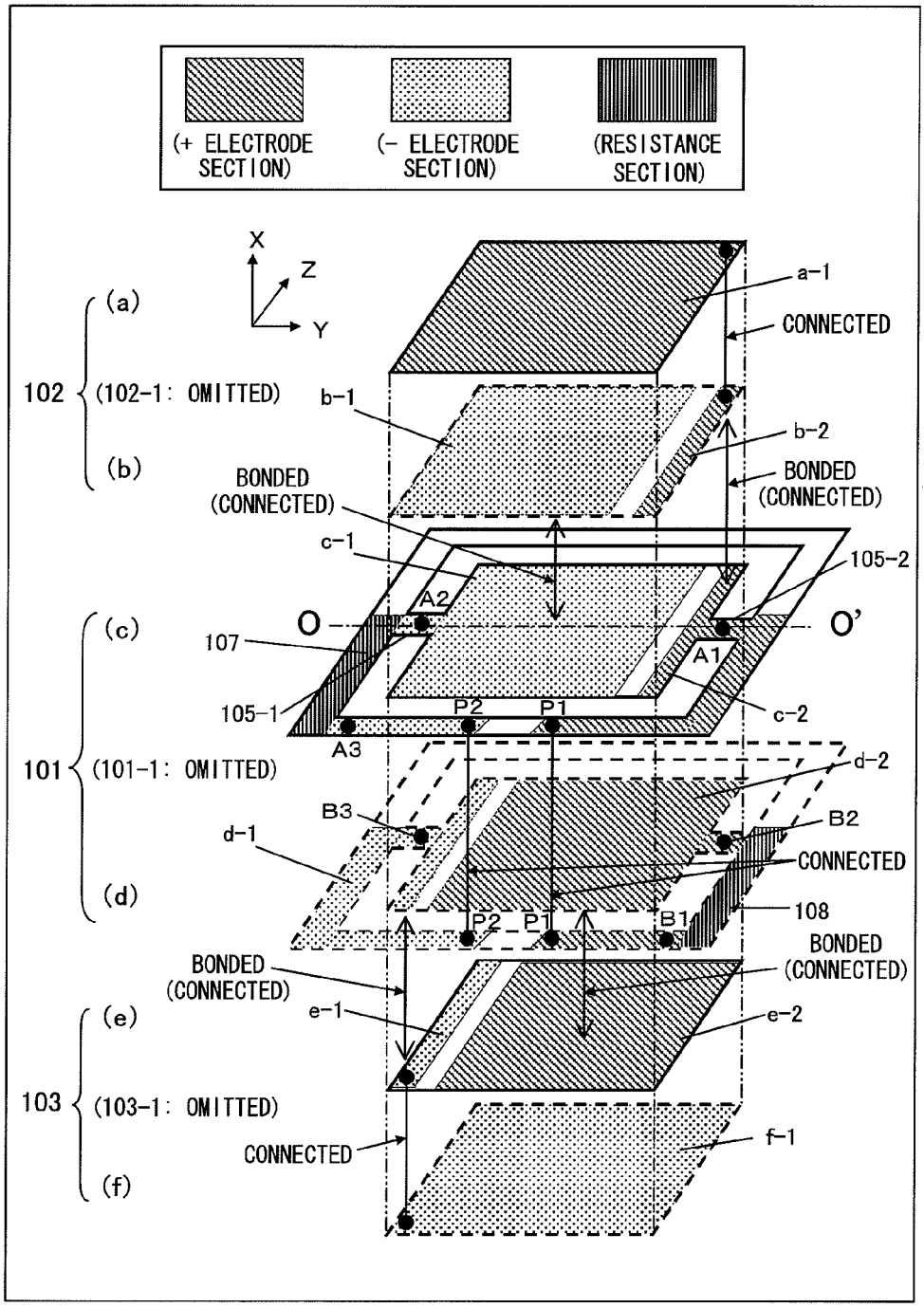
FIG. 2 is a diagrammatic perspective view for describing each electrode layer that constructs the piezoelectric type loudspeaker 100 according to the first embodiment of the present invention.

FIG. 2 is a diagrammatic perspective view for describing each electrode layer that constructs the piezoelectric type loudspeaker 100 according to the first embodiment. Additionally, in FIG. 2, in each of the electrode layers, the +electrode section, the – electrode section, and the resistance section, are graphically represented respectively with the same patterns used in FIG. 1. Furthermore, in FIG. 2, the piezoelectric material 102-1, the piezoelectric material 103-1, and the substrate 101-1 are omitted for convenience of description. In the following, a layout and connection relationships of electrodes in each of the electrode layers that construct the piezoelectric type loudspeaker 100, are described with reference to FIG. 1 and FIG. 2.

First the layout of the electrodes in each of the electrode layers in the piezoelectric type loudspeaker 100 is described with reference to FIG. 2 and (B) of FIG. 1. An electrode a-1 is formed on the entire surface of the electrode layer a. An electrode b-1 and an electrode b-2 are formed on the electrode layer b. The electrode b-2 is formed in a thin strip-shaped form along the end of the electrode layer b in the Y-axis direction. The electrode b-1 is formed on the remaining surface of the electrode layer b while maintaining a gap in between the electrode b-2. The electrode b-1 and the electrode b-2 are electrical insulated from each other. An electrode c-1 and an electrode c-2 are formed on the electrode layer c. The electrode c-1 is integrally formed to, a part that overlaps with the electrode b-1 when viewed from the X-axis direction, the supporting section 105-1 of the diaphragm 101, and one part of the frame section 104. Furthermore, in the electrode c-1, a resistance section 107 is formed on one part of the frame section 104. The electrode c-2 is integrally formed to, a part that overlaps with the electrode b-2 when viewed from the X-axis direction, the supporting section 105-2 of the diaphragm 101, and one part of the frame section 104. The electrode c-1 and the electrode c-2 are electrically insulated from each other.

An electrode d-1 and an electrode d-2 are formed on the electrode layer d, having shapes that can be obtained if electrodes (electrode c-1 and electrode c-2) formed on the electrode layer c have been flipped over using the Z-axis as a rotational axis. Hence, the electrode d-1 has a shape that can be obtained if the electrode c-2 has been flipped over using the Z-axis as a rotational axis; and the electrode d-2 has a shape that can be obtained if the electrode c-1 has been flipped over by using the Z-axis as a rotational axis. Furthermore, the electrode d-1 and the electrode d-2 are electrically insulated from each other. Similarly, an electrode e-1 and an electrode e-2 are formed on the electrode layer e, having shapes that can be obtained if electrodes (electrode b-1 and electrode b-2) formed on the electrode layer b have been flipped over using the Z-axis as a rotational axis. Hence, the electrode e-1 has a shape that can be obtained if the electrode b-2 has been flipped over using the Z-axis as a rotational axis; and the electrode e-2 has a shape obtained if the electrode b-1 has been flipped over using the Z-axis as a rotational axis. In addition, the electrode e-1 and the electrode e-2 are electrically insulated from each other. An electrode f-1 is formed on the entire surface of the electrode layer f.

Next, the connection relationships of each of the electrodes are described. Since the electrode layer b and the electrode layer c are bonded to each other: a part of the electrode c-1 formed on the upper surface of the vibrating section 106 and the electrode b-1 are bonded and electrically connected; and a part of the electrode c-2 formed on the upper surface of the vibrating section 106 and the electrode b-2 are bonded and electrically connected. Similarly, since the electrode layer e and the electrode layer d are bonded to each other: a part of the electrode d-1 formed on the lower surface of the vibrating section 106 and the electrode e-1 are bonded and electrically connected; and a part of the electrode d-2 formed on the lower surface of the vibrating section 106 and the electrode e-2 are bonded and electrically connected.

The electrode a-1 and the electrode b-2 are electrically connected. Similarly, the electrode f-1 and the electrode e-1 are electrically connected. Furthermore, a point P2 of the electrode c-1 on the upper surface of the frame section 104 and a point P2 of the electrode d-1 on the lower surface of the frame section 104 are electrically connected. Similarly, a point P1 of the electrode c-2 on the upper surface of the frame section 104 and a point P1 of the electrode d-2 on the lower surface of the frame section 104 are electrically connected. Means for attaining these connections are, for example, through-hole processing and external wiring processing. For example, in (B) of FIG. 1, a connection is attained by applying an external wiring processing that forms wiring on side surfaces of the piezoelectric material 102-1 and the piezoelectric material 103-1.

Figure 3:
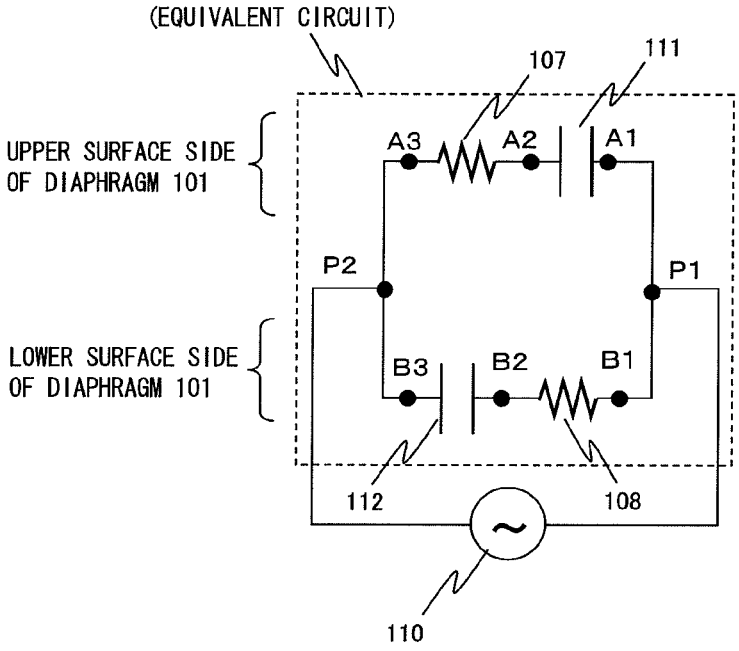
FIG. 3 is a figure showing an equivalent circuit of the piezoelectric type loudspeaker 100 according to the first embodiment of the present invention.

FIG. 3 is a figure showing an equivalent circuit of the piezoelectric type loudspeaker 100 according to the first embodiment. The equivalent circuit of the piezoelectric type loudspeaker 100 is described in the following with reference to FIG. 2 and FIG. 3. As shown in FIG. 3, the equivalent circuit of the piezoelectric type loudspeaker 100 includes: an RC circuit that is formed by connecting a resistance 107 and a capacitor 111 in series; and an RC circuit that is formed by connecting a capacitor 112 and a resistance 108 in series. At P2, one end A3 of the RC circuit that is formed by connecting the resistance 107 and the capacitor 111 in series, is connected to one end B3 of the RC circuit that is formed by connecting the capacitor 112 and the resistance 108 in series. At P1, the other end A1 of the RC circuit that is formed by connecting the resistance 107 and the capacitor 111 in series, is connected to the other end B1 of the RC circuit that is formed by connecting the capacitor 112 and the resistance 108 in series. The P1 and the P2 are respectively connected to an alternating-current power supply 110.

In the following, the equivalent circuit in FIG. 3 is described in relation to each of the electrodes in FIG. 2. First, the P2 in FIG. 3 corresponds to the point P2 of the electrode c-1 and the point P2 of the electrode d-1 in FIG. 2. Although there are two point P2*s* in FIG. 2, these two point P2*s* are connected to each other, and thereby regarded as one P2 on the circuit in FIG. 3. The A3 in FIG. 3 corresponds to a point A3 of the electrode c-1 in FIG. 2. The resistance 107 in FIG. 3 corresponds to the resistance section 107 in FIG. 2. A2 in FIG. 3 corresponds to a point A2 of the electrode c-1 in FIG. 2. The capacitor 111 in FIG. 3 corresponds to the electrode b-1, one part of the electrode c-1, and the electrode a-1, in FIG. 2. More specifically, an electrode on the A2 side of the capacitor 111 in FIG. 3 corresponds to, among the electrode b-1 and the electrode c-1 in FIG. 2, a part that overlaps with the electrode b-1. Furthermore, an electrode on the A1 side of the capacitor 111 in FIG. 3 corresponds to the electrode a-1 in FIG. 2. The A1 in FIG. 3 corresponds to a point A1 of the electrode c-2 in FIG. 2. The P1 in FIG. 3 corresponds to the point P1 of the electrode c-2 and the point P1 of the electrode d-2 in FIG. 2. Although there are two point P1*s* in FIG. 2, these two point P1*s* are connected to each other, and thereby regarded as one P1 on the circuit in FIG. 3.

B1 in FIG. 3 corresponds to a point B1 of the electrode d-1 in FIG. 2. The resistance 108 in FIG. 3 corresponds to the resistance section 108 in FIG. 2. B2 in FIG. 3 corresponds to a point B2 of the electrode d-2 in FIG. 2. The capacitor 112 in FIG. 3 corresponds to the electrode e-2, one part of the electrode d-2, and the electrode f-1 in FIG. 2. More specifically, an electrode on the B2 side of the capacitor 112 in FIG. 3 corresponds to, among the electrode e-2 and the electrode d-2 in FIG. 2, a part that overlaps with the electrode e-2. Furthermore, an electrode on the B3 side of the capacitor 112 in FIG. 3 corresponds to the electrode f-1 in FIG. 2. The B3 in FIG. 3 corresponds to a point B3 of the electrode d-1 in FIG. 2.

As described above, in the piezoelectric type loudspeaker 100 according to the first embodiment of the present invention, the resistance, which is connected in series with the piezoelectric element and has a property of a capacitor, is integrally formed to one part of the electrode formed on the diaphragm surface by using a printing technology and the like. By this, it is possible to flatten the sound pressure characteristic without increasing the number of parts, and in addition, attain space-saving. Additionally, according to the piezoelectric type loudspeaker 100, supporting the vibrating section with the supporting section allows the vibrating section to vibrate easily at low frequency. By this, it is possible to play a low pitch sound with high sound quality.

Furthermore, in the piezoelectric type loudspeaker 100 according to the first embodiment of the present invention, a print pattern used for printing the electrodes may be shared for printing the front and rear surfaces of the loudspeaker. Specifically, as already described, the electrodes in the electrode layer d and the electrodes in the electrode layer c can be formed by using an identical print pattern, since the shape of the electrodes in electrode layer d has a shape that can be obtained if the electrodes in the electrode layer c has been flipped over (refer FIG. 2). Similarly, the electrodes in the electrode layer b and the electrodes in the electrode layer e can be formed by using an identical print pattern. Moreover, similarly, the electrodes in the electrode layer a and the electrodes in the electrode layer f can be formed by using an identical print pattern. As a result, it is possible to reduce manufacturing cost.

Furthermore, in the piezoelectric type loudspeaker 100 according to the first embodiment of the present invention, the filler 109 is applied on the surfaces of the frame section 104 and the supporting section 105 (refer (A) to (C) of FIG. 1). As already described, since the filler 109 consists of a material that has high heat conductivity, heat generated at the resistance section 107 and 108, which are formed on the surface of the frame section 104, is effectively dissipated. As a result, according to the piezoelectric type loudspeaker 100 of the present invention, performance deterioration of the piezoelectric material 102-1 and 103-1 due to reduction in the capacitance by a pyroelectric effect can be avoided.

Second Embodiment

In addition to the characteristics of the piezoelectric type loudspeaker 100 according to the first embodiment, a piezoelectric type loudspeaker 200 according to a second embodiment has a characteristic in which an electrode of a piezoelectric element is split plurally, and an electrode connected to a resistance in series and an electrode not connected to a resistance are provided. Description centered on this characteristic is given in the following, and descriptions of characteristics in common with the piezoelectric type loudspeaker 100 according to the first embodiment are omitted in principle.

Figure 4:
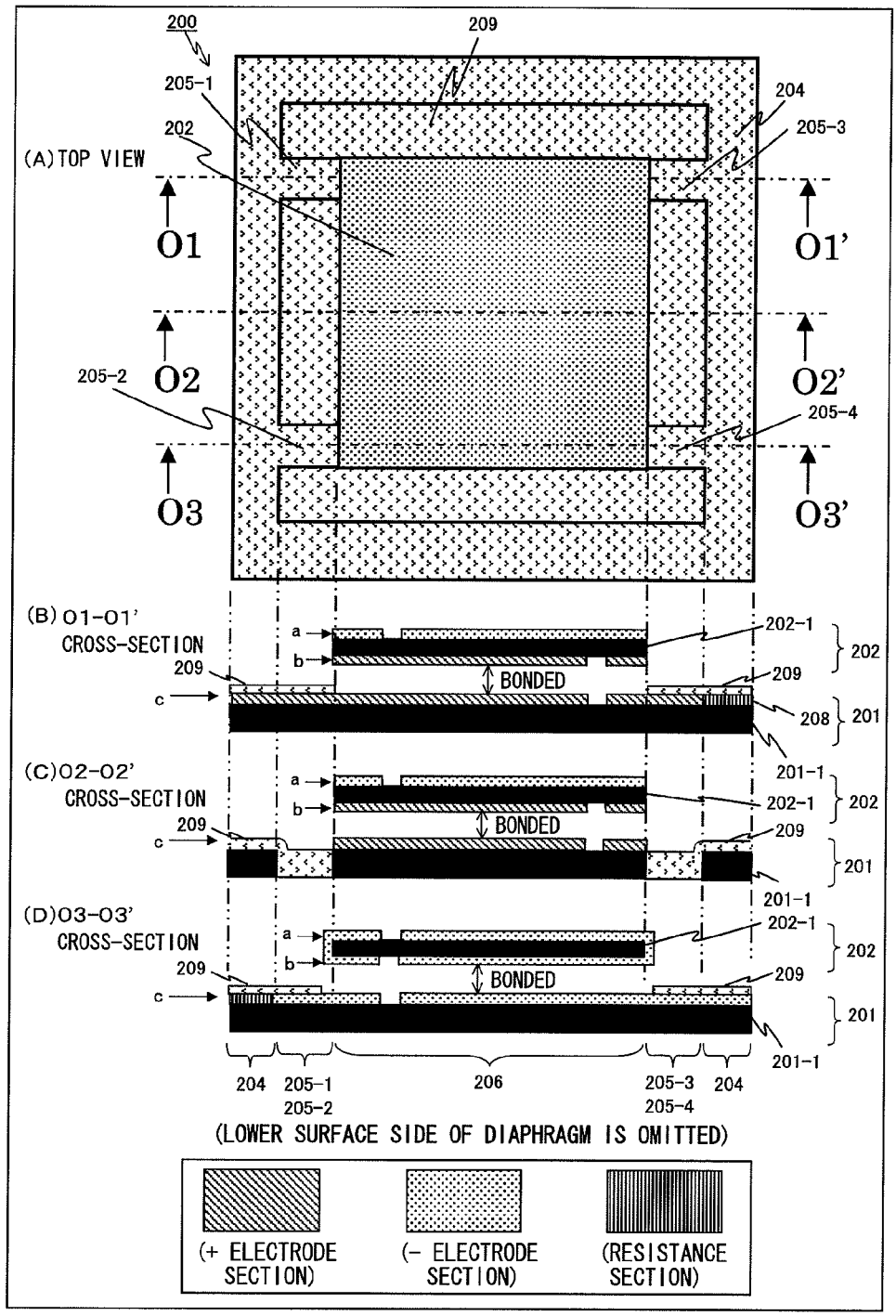
FIG. 4 is a top view and cross sectional views of one example of a piezoelectric type loudspeaker 200 according to a second embodiment of the present invention.

FIG. 4 is a top view and cross sectional views of one example of the piezoelectric type loudspeaker 200 according to the second embodiment. In FIG. 4, (A) is a top view, (B) is a cross-sectional view of O1-O1', (C) is a cross-sectional view of O2-O2', and (D) is a cross-sectional view of O3-O3'. As shown in (A) to (D) of FIG. 4, the piezoelectric type loudspeaker 200 includes: a diaphragm 201; a piezoelectric element 202; a piezoelectric element 203; and a filler 209. Here, the configuration of the lower surface side of the diaphragm 201 is omitted for convenience of description in (A) to (D) of FIG. 4. Thus, the piezoelectric element 203 is not graphically represented. Furthermore, in the following, description of the configuration of the lower surface side of the diaphragm 201 is omitted. Still further, in (B) to (D) of FIG. 4, the diaphragm 201 and the piezoelectric element 202 are illustrated separately for convenience of description; however, in practice, the diaphragm 201 and the piezoelectric element 202 are bonded to each other.

The piezoelectric element 202 includes: a piezoelectric material 202-1; an electrode layer a formed on the upper surface of the piezoelectric material 202-1; and an electrode layer b formed on the lower surface of the piezoelectric material 202-1 (refer (B) to (D) of FIG. 4).

The diaphragm 201 includes: a substrate 201-1; and an electrode layer c formed on the upper surface of the substrate 201-1. When classified functionally, the diaphragm 201 includes: a frame section 204; supporting sections 205-1 to 205-4; and a vibrating section 206 (refer (B) to (D) of FIG. 4).

The filler 209 fills gaps among the frame section 204, the supporting sections 205-1 to 205-4, and the vibrating section 206. Furthermore, the filler 209 is also applied on the surfaces of the frame section 204 and the supporting sections 205-1 to 205-4 (refer (A) to (D) of FIG. 4).

Figure 5:
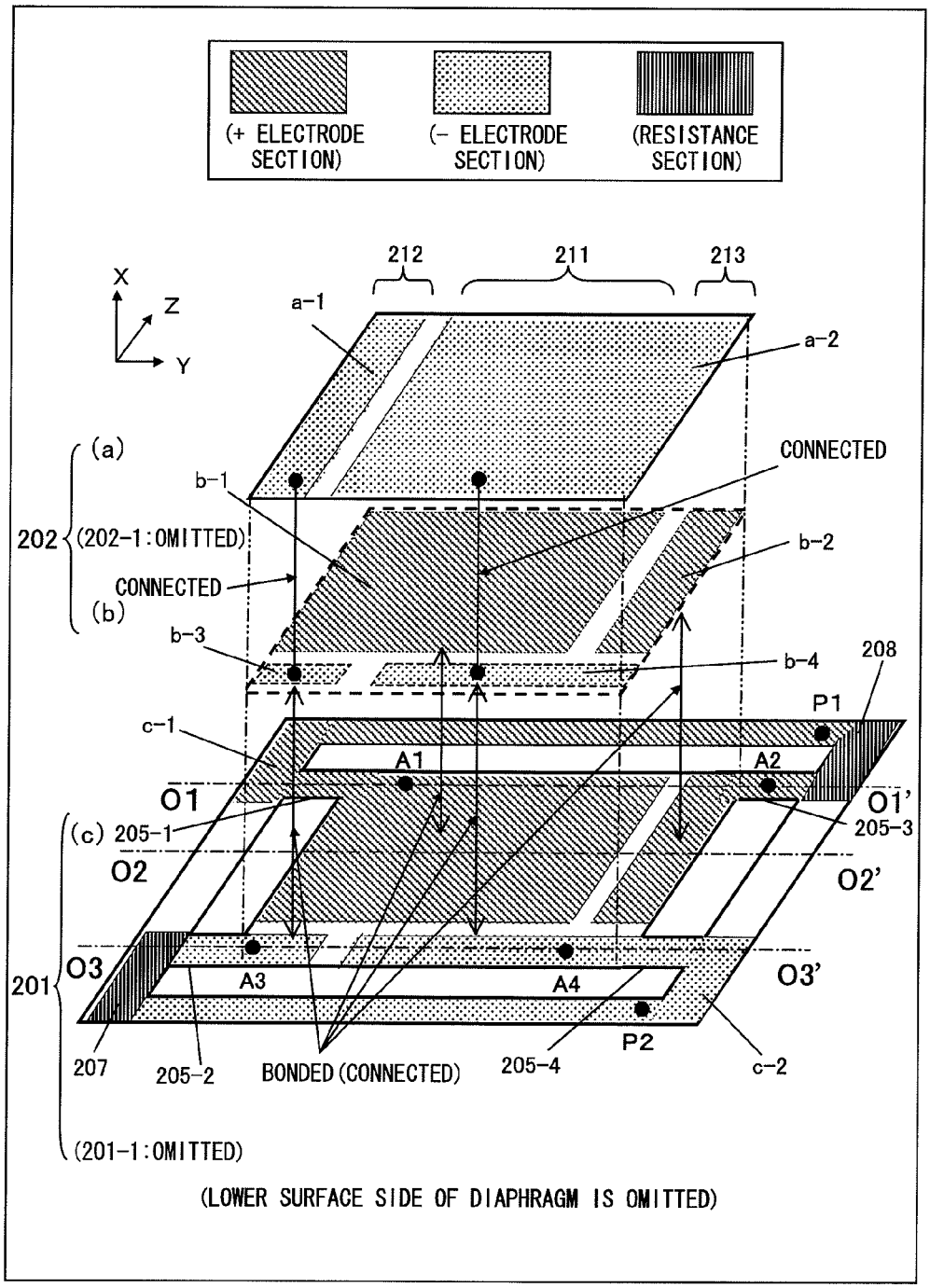
FIG. 5 is a diagrammatic perspective view for describing each electrode layer that constructs the piezoelectric type loudspeaker 200 according to the second embodiment of the present invention.

FIG. 5 is a diagrammatic perspective view for describing each of the electrode layers that construct the piezoelectric type loudspeaker 200 according to the second embodiment. Here, in FIG. 5, the piezoelectric material 202-1 and the substrate 201-1 are omitted. Furthermore, the configuration of the lower surface side of the diaphragm 201 is also omitted. In the following, a layout and connection relationships of electrodes in each of the electrode layers that construct the piezoelectric type loudspeaker 200, are described with reference to FIG. 5.

First, the layout of the electrodes in each of the electrode layers in the piezoelectric type loudspeaker 200 is described. An electrode a-1 and an electrode a-2 are formed on the electrode layer a. An electrode b-1, an electrode b-2, an electrode b-3, and an electrode b-4 are formed on the electrode layer b. The electrodes b-1 to b-4 are electrically insulated from each other. An electrode c-1 and an electrode c-2 are formed on the electrode layer c. The electrode c-1 is integrally formed to, a part that overlaps with the electrode b-1 when viewed from the X-axis direction, a part that overlaps with the electrode b-2 when viewed from the X-axis direction, the supporting sections 205-1 and 205-3 of the diaphragm 201, and one part of the frame section 204. Furthermore, in the electrode c-1, a resistance section 208 is formed on one part of the frame section 204. The electrode c-2 is integrally formed to, a part that overlaps with the electrode b-3 when viewed from the X-axis direction, a part that overlaps with the electrode b-4 when viewed from the X-axis direction, the supporting sections 205-2 and 205-4 of the diaphragm 201, and one part of the frame section 204. In addition, in the electrode c-2, a resistance section 207 is formed on one part of the frame section 204. The electrode c-1 and the electrode c-2 do not have any part that makes contact with the other, and are electrically insulated from each other.

Next, the connection relationships of each of the electrodes are described with reference to FIG. 5. Since the electrode layer b and the electrode layer c are bonded to each other, the electrode b-1 and a part of the electrode c-1 corresponding to the electrode b-1 are bonded and electrically connected. Similarly, the electrode b-2 and a part of the electrode c-1 corresponding to the electrode b-2 are bonded and electrically connected. Furthermore, the electrode b-3 and a part of the electrode c-2 corresponding to the electrode b-3 are bonded and electrically connected. Similarly, the electrode b-4 and a part of the electrode c-4 corresponding to the electrode b-4 are bonded and electrically connected.

The electrode a-1 and the electrode b-3 are electrically connected. Similarly, the electrode a-2 and the electrode b-4 are electrically connected. Means for attaining these connections are, for example, through-hole processing and external wiring processing. In (D) of FIG. 4, a connection is attained by applying an external wiring processing that forms wiring on one part of a side surface of the piezoelectric material 202-1.

Figure 6:
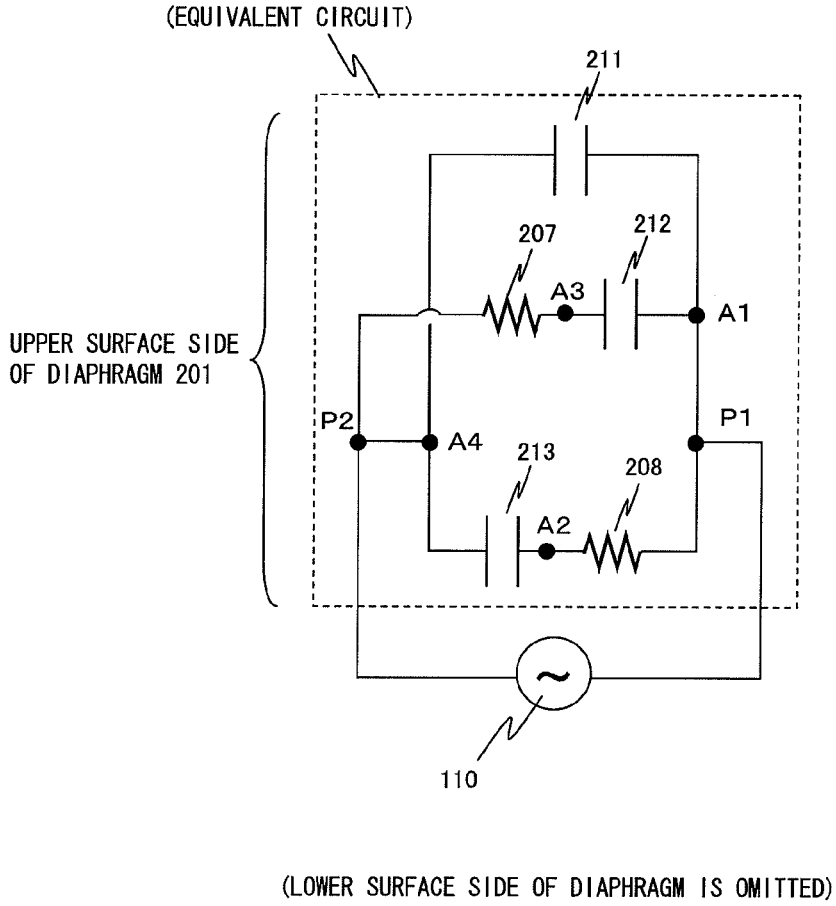
FIG. 6 is a figure showing an equivalent circuit of the piezoelectric type loudspeaker 200 according to the second embodiment of the present invention.

FIG. 6 is a figure showing an equivalent circuit of the piezoelectric type loudspeaker 200 according to the second embodiment. The equivalent circuit of the piezoelectric type loudspeaker 200 is described in the following with reference to FIG. 5 and FIG. 6. In FIG. 6, the equivalent circuit located on the lower surface side of the diaphragm 201 is omitted. As shown in FIG. 6, the equivalent circuit of the piezoelectric type loudspeaker 200 includes: an RC circuit in which a resistance 207 and a capacitor 212 are connected in series; an RC circuit in which a capacitor 213 and a resistance 208 are connected in series; and a capacitor 211. The capacitor 213 side end of the RC circuit, in which the capacitor 213 and the resistance 208 are connected in series, and one end of the capacitor 211 are connected at A4. Furthermore, the resistance 208 side end of the RC circuit, in which the capacitor 213 and the resistance 208 are connected in series, and the other end of the capacitor 211 are connected at P1 via A1. The capacitor 212 side end of the RC circuit, in which the resistance 207 and the capacitor 212 are connected in series, is connected to the A1. The resistance 207 side end of the RC circuit, in which the resistance 207 and the capacitor 212 are connected in series, is connected to the A4 via P2. The P1 and the P2 are respectively connected to the alternating-current power supply 110.

In the following, the equivalent circuit in FIG. 6 is described in relation to each of the electrodes in FIG. 5. First, the P2 in FIG. 6 corresponds to a point P2 of the electrode c-2 in FIG. 5. The A4 in FIG. 6 corresponds to a point A4 of the electrode c-2 in FIG. 5. The capacitor 211 in FIG. 6 corresponds to, in FIG. 5, one part of the electrode a-2, one part of the electrode b-1, and one part of the electrode c-1. More specifically, an electrode on the A4 side of the capacitor 211 in FIG. 6 corresponds to a part that overlaps with the electrode b-1 on the electrode a-2 in FIG. 5. Furthermore, an electrode on the P1 side of the capacitor 211 in FIG. 6 corresponds to, in FIG. 5, a part that overlaps with the electrode a-2 on the electrode b-1, and a part that overlaps with the electrode a-2 on the electrode c-1.

The capacitor 213 in FIG. 6 corresponds to, in FIG. 5, one part of the electrode a-2, the electrode b-2, and one part of the electrode c-1. More specifically, an electrode on the A4 side of the capacitor 213 in FIG. 6 corresponds to a part that overlaps with the electrode b-2 on the electrode a-2 in FIG. 5. Furthermore, an electrode on the A2 side of the capacitor 213 in FIG. 6 corresponds to, in FIG. 5, the electrode b-2, and a part that overlaps with the electrode b-2 on the electrode c-1. A2 in FIG. 6 corresponds a point A2 on the electrode c-1 in FIG. 5. The resistance 208 in FIG. 6 corresponds to the resistance section 208 in FIG. 5. The P1 in FIG. 6 corresponds to a point P1 on the electrode c-2 in FIG. 5.

The A1 in FIG. 6 corresponds to a point A1 on the electrode c-2 in FIG. 5. The capacitor 212 in FIG. 6 corresponds to, in FIG. 5, the electrode a-1, one part of the electrode b-1, and one part of the electrode c-1. More specifically, an electrode on the A1 side of the capacitor 212 in FIG. 6 corresponds to, in FIG. 5, a part that overlaps with the electrode a-1 on the electrode c-1, and a part that overlaps with the electrode a-1 on the electrode b-1. Furthermore, an electrode on the A3 side of the capacitor 212 in FIG. 6 corresponds to the electrode a-1 in FIG. 5. A3 in FIG. 6 corresponds to a point A3 on the electrode c-2 in FIG. 5. The resistance 207 in FIG. 6 corresponds to the resistance section 207 in FIG. 5.

As described above, in addition to the characteristics of the piezoelectric type loudspeaker 100 according to the first embodiment, the piezoelectric type loudspeaker 200 according to the second embodiment of the present invention has the characteristic in which the electrode of the piezoelectric element is split plurally, and the electrode connected to the resistance in series and the electrode not connected to a resistance are provided. As a result, in addition to the advantageous effect of the piezoelectric type loudspeaker 100 according to the first embodiment, according to the piezoelectric type loudspeaker 200, the sound pressure characteristic can be flat only in one part of an area of the piezoelectric element (an area where the resistance is connected in series). For example, by not connecting a resistance to a split electrode in the central area of the piezoelectric element and connecting a resistance to split electrode in the peripheral area of the piezoelectric element, sounds in the low frequency range can be driven in the whole area of the piezoelectric element, on the other hand, sounds in the high frequency range can be driven only in the central part of the piezoelectric element. Thus, according to the piezoelectric type loudspeaker 200, a two-way loudspeaker can be attained by a single layer of the piezoelectric element.

Additionally, in the description above, the sound pressure characteristic is regulated by whether or not a resistance is connected to the split electrode. However, the sound pressure characteristic may be properly regulated further by regulating a value of the resistance connected to the split electrode.

Third Embodiment

In addition to the characteristics of the piezoelectric type loudspeaker 100 according to the first embodiment, a piezoelectric type loudspeaker 300 according to a third embodiment has a characteristic in which an electrode of a piezoelectric element is split plurally, and a reverse voltage is applied to one part of the electrode. Description centered on this characteristic is given in the following, and descriptions of characteristics in common with the piezoelectric type loudspeaker 100 according to the first embodiment are omitted in principle. As a footnote, descriptions with reference to a top view and a cross sectional view of the piezoelectric type loudspeaker 300 are omitted for the third embodiment. Additionally, description of the configuration of the lower surface side of the diaphragm is omitted in the following.

Figure 7:
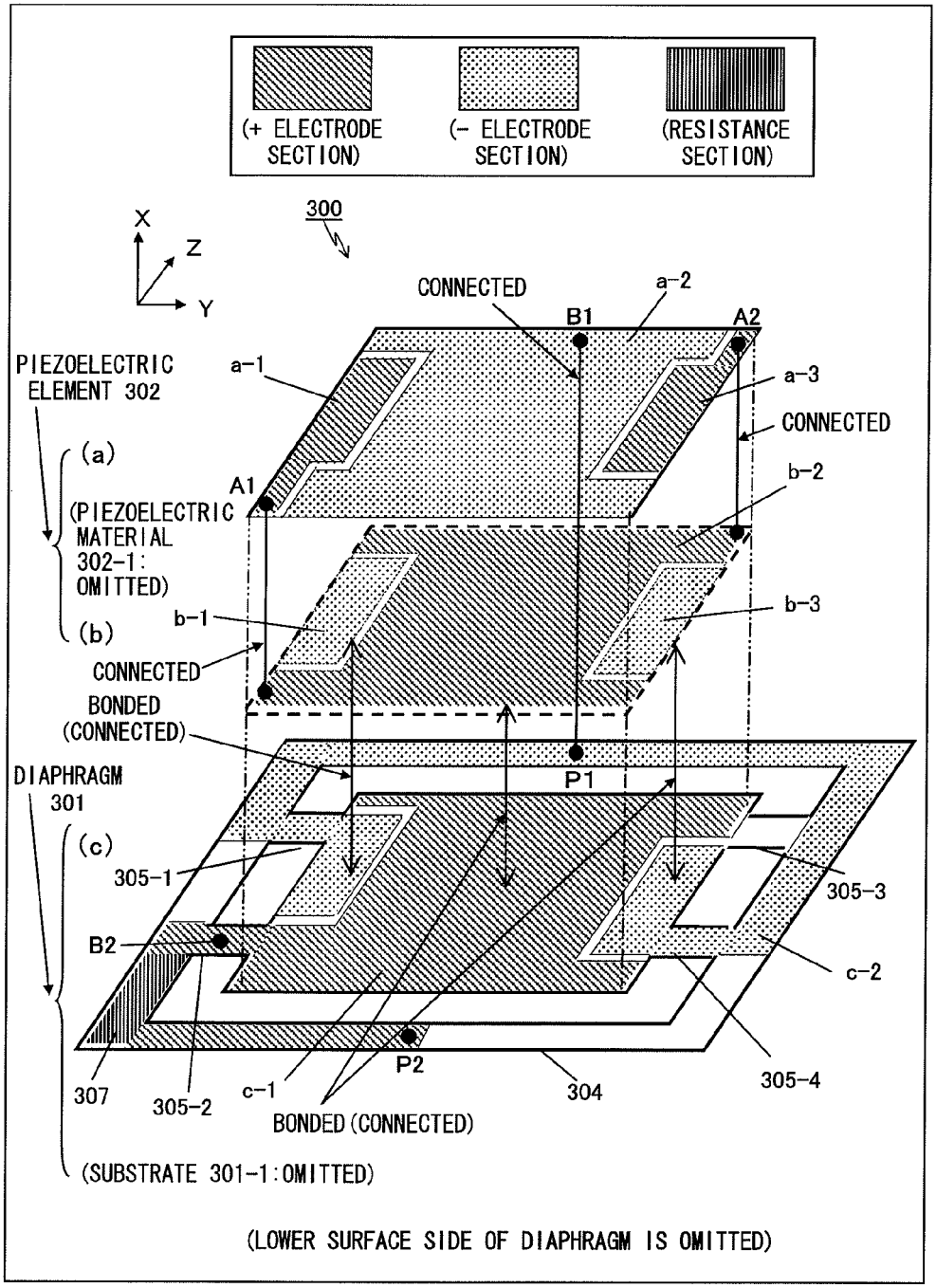
FIG. 7 is a diagrammatic perspective view for describing each electrode layer that constructs a piezoelectric type loudspeaker 300 according to a third embodiment of the present invention.

FIG. 7 is a diagrammatic perspective view for describing each electrode layer that constructs the piezoelectric type loudspeaker 300 according to the third embodiment. Here, in FIG. 7: a piezoelectric material 302-1 which is a component of a piezoelectric element 302 is omitted; a substrate 301-1 which is a component of a diaphragm 301 is omitted; and the configuration of the lower surface side of the diaphragm 301 is also omitted. In the following, a layout and connection relationships of electrodes in each of the electrode layers that construct the piezoelectric type loudspeaker 300, are described with reference to FIG. 7.

First, the layout of the electrodes in each of the electrode layers in the piezoelectric type loudspeaker 300 is described. An electrode a-1, an electrode a-2, and an electrode a-3 are formed on an electrode layer a. The electrodes a-1 to a-3 are electrically insulated from each other. An electrode b-1, an electrode b-2, and an electrode b-3 are formed on an electrode layer b. The electrodes b-1 to b-3 are electrically insulated from each other. An electrode c-1 and an electrode c-2 are formed on an electrode layer c. The electrode c-1 is integrally formed to, a part that overlaps with the electrode b-2 when viewed from the X-axis direction, a supporting section 305-2 of the diaphragm 301, and one part of a frame section 304 of the diaphragm 301. Furthermore, in the electrode c-1, a resistance section 307 is formed on one part of the frame section 304. The electrode c-2 is integrally formed to, a part that overlaps with the electrode b-1 when viewed from the X-axis direction, a part that overlaps with the electrode b-3 when viewed from the X-axis direction, supporting sections 305-1 and 305-4 of the diaphragm 301, and one part of the frame section 304. The electrode c-1 and the electrode c-2 do not have any part that makes contact with the other, and are electrically insulated from each other.

Next, the connection relationships of each of the electrodes are described. Since the electrode layer b and the electrode layer c are bond to each other, the electrode b-2 and a part of the electrode c-1 corresponding to the electrode b-2 are bonded and electrically connected. Furthermore, the electrode b-1 and a part of the electrode c-2 corresponding to the electrode b-1 are bonded and electrically connected. Similarly, the electrode b-3 and a part of the electrode c-2 corresponding to the electrode b-3 are bonded and electrically connected.

The electrode a-1 and the electrode b-2 are electrically connected. Similarly, the electrode a-3 and the electrode b-2 are electrically connected. Furthermore, the electrode a-2 and the electrode c-2 are electrically connected. Means for attaining these connections are, for example, through-hole processing and external wiring processing.

Figure 8:
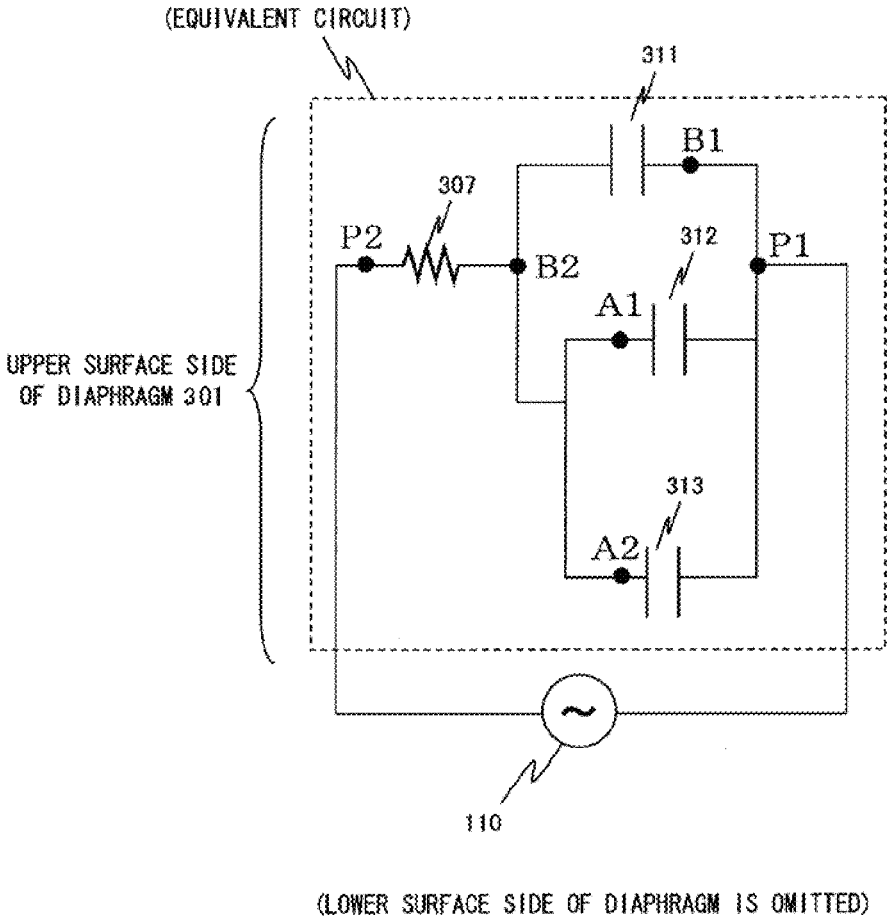
FIG. 8 is a figure showing an equivalent circuit of the piezoelectric type loudspeaker 300 according to the third embodiment of the present invention.

FIG. 8 is a figure showing an equivalent circuit of the piezoelectric type loudspeaker 300 according to the third embodiment. The equivalent circuit of the piezoelectric type loudspeaker 300 is described in the following with reference to FIG. 7 and FIG. 8. In FIG. 8, the equivalent circuit located on the lower surface side of the diaphragm 301 is omitted. As shown in FIG. 8, the equivalent circuit of the piezoelectric type loudspeaker 300 is a circuit in which a resistance 307 is connected in series with another circuit that is constructed by parallelly connecting a capacitor 311, a capacitor 312, and a capacitor 313.

In the following, the equivalent circuit in FIG. 8 is described in relation to each of the electrodes in FIG. 7. First, P2 in FIG. 8 corresponds to a point P2 of the electrode c-1 in FIG. 7. The resistance 307 in FIG. 8 corresponds to the resistance section 307 in FIG. 7. B2 in FIG. 8 corresponds to a point B2 of the electrode c-1 in FIG. 7. The capacitor 311 in FIG. 8 corresponds to, in FIG. 7, one part of the electrode c-1, the electrode b-2, and the electrode a-2. More specifically, an electrode on the B2 side of the capacitor 311 in FIG. 8 corresponds to, in FIG. 7, a part that overlaps with the electrode b-2 on the electrode c-1, and the electrode b-2. Furthermore, an electrode on the B1 side of the capacitor 311 in FIG. 8 corresponds to the electrode a-2 in FIG. 7. B1 in FIG. 8 corresponds to a point B1 of the electrode a-2 in FIG. 7. P1 in FIG. 8 corresponds to a point P1 of the electrode c-2 in FIG. 7.

A1 in FIG. 8 corresponds to a point A1 of the electrode a-1 in FIG. 7. The capacitor 312 in FIG. 8 corresponds to, in FIG. 7, one part of the electrode c-2, the electrode b-1, and the electrode a-1. More specifically, an electrode on the A1 side of the capacitor 312 in FIG. 8 corresponds to the electrode a-1 in FIG. 7. Furthermore, an electrode on the P1 side of the capacitor 312 in FIG. 8 corresponds to, in FIG. 7, the electrode b-1, and a part that overlaps with the electrode b-1 on the electrode c-2.

A2 in FIG. 8 corresponds to a point A2 of the electrode a-3 in FIG. 7. The capacitor 313 in FIG. 8 corresponds to, in FIG. 7, one part of the electrode c-2, the electrode b-3, and the electrode a-3. More specifically, an electrode on the A2 side of the capacitor 313 in FIG. 8 corresponds to the electrode a-3 in FIG. 7. Furthermore, an electrode on the P1 side of the capacitor 313 in FIG. 8 corresponds to, in FIG. 7, the electrode b-3, and a part that overlaps with the electrode b-3 on the electrode c-2.

As described above, in addition to the characteristics of the piezoelectric type loudspeaker 100 according to the first embodiment, the piezoelectric type loudspeaker 300 according to the third embodiment of the present invention has the characteristic in which the electrode of the piezoelectric element is split plurally, and a reverse voltage is applied to one part of the electrode. As a result, in addition to the advantageous effect of the piezoelectric type loudspeaker 100 according to the first embodiment, according to the piezoelectric type loudspeaker 300, an unnecessary vibrational mode that is generated on the diaphragm can be effectively cancelled out.

The number of supporting sections that support the vibrating section has been specifically described in the first to third embodiment for convenience of description. However, the number of supporting sections is not limited to the number that has been used in the descriptions.

Fourth Embodiment

A piezoelectric type loudspeaker 400 according to a fourth embodiment differs from the piezoelectric type loudspeaker 100 according to the first embodiment, mainly in points such as absence of a supporting section for the diaphragm, and absence of a filler. In the following, descriptions are centered on these different points.

Figure 9:
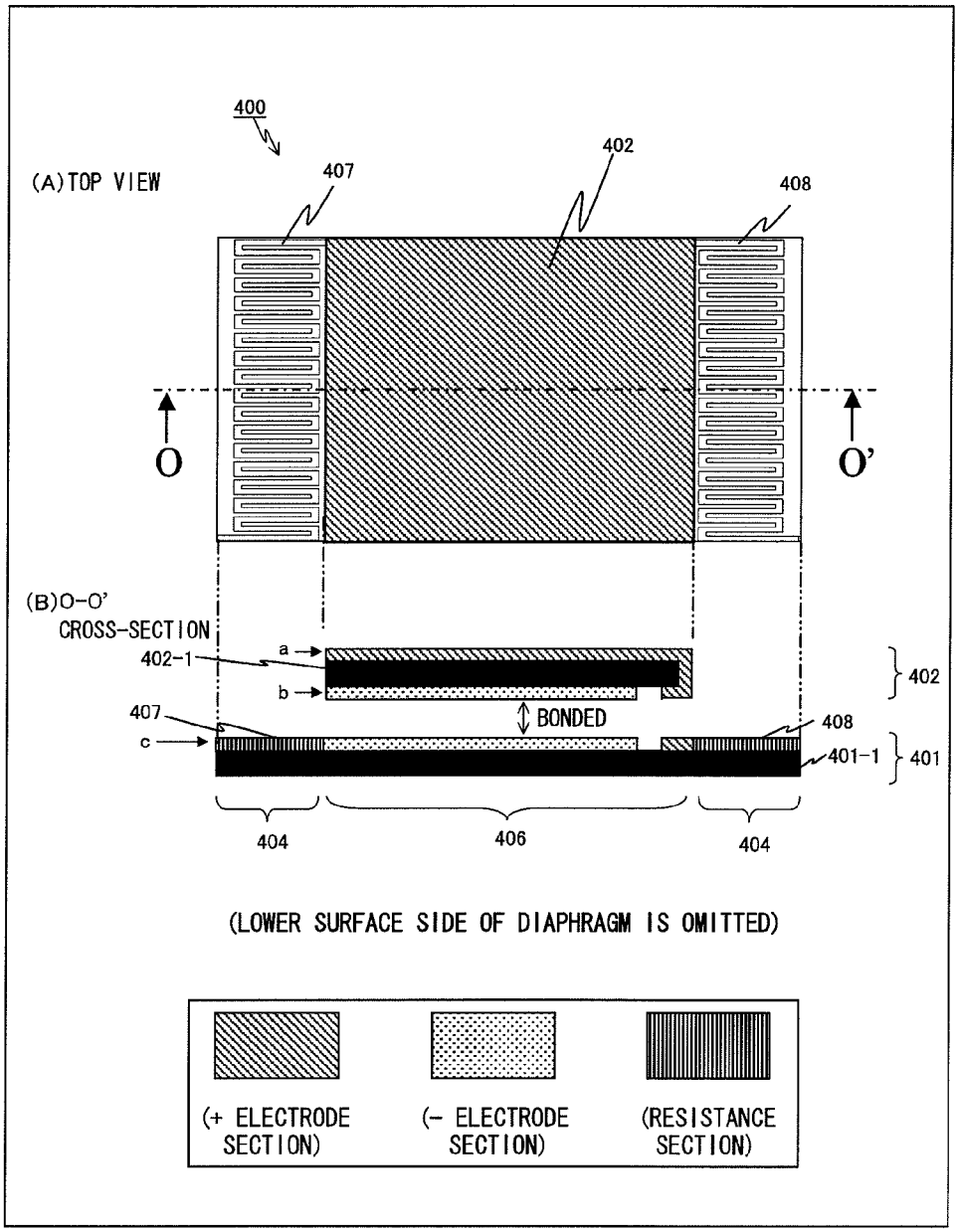
FIG. 9 is a top view and a cross sectional view of one example of a piezoelectric type loudspeaker 400 according to a fourth embodiment of the present invention.

FIG. 9 is a top view and a cross sectional view of one example of the piezoelectric type loudspeaker 400 according to the fourth embodiment. In FIG. 9, (A) is a top view, and (B) is a cross-sectional view of O-O'. As shown in (A) and (B) of FIG. 9, the piezoelectric type loudspeaker 400 includes: a diaphragm 401; a piezoelectric element 402; and a piezoelectric element 403. Here, the configuration of the lower surface side of the diaphragm 401 is omitted for convenience of description in (A) and (B) of FIG. 4. Thus, the piezoelectric element 403 is not graphically represented. Furthermore, in the following, the description of the configuration of the lower surface side of the diaphragm 401 is omitted. Still further, in (B) of FIG. 9, the diaphragm 401 and the piezoelectric element 402 are illustrated separately for convenience of description; however, in practice, the diaphragm 401 and the piezoelectric element 402 are bonded to each other.

The piezoelectric element 402 includes: a piezoelectric material 402-1; an electrode layer a which is formed on the upper surface of the piezoelectric material 402-1; and a electrode layer b which is formed on the lower surface of the piezoelectric material 402-1 (refer (B) of FIG. 9).

The diaphragm 401 includes: a substrate 401-1; and an electrode layer c formed on the upper surface of the substrate 401-1. When classified functionally, the diaphragm 401 includes: frame sections 404; and a vibrating section 406 (refer (B) of FIG. 9)

Figure 10:
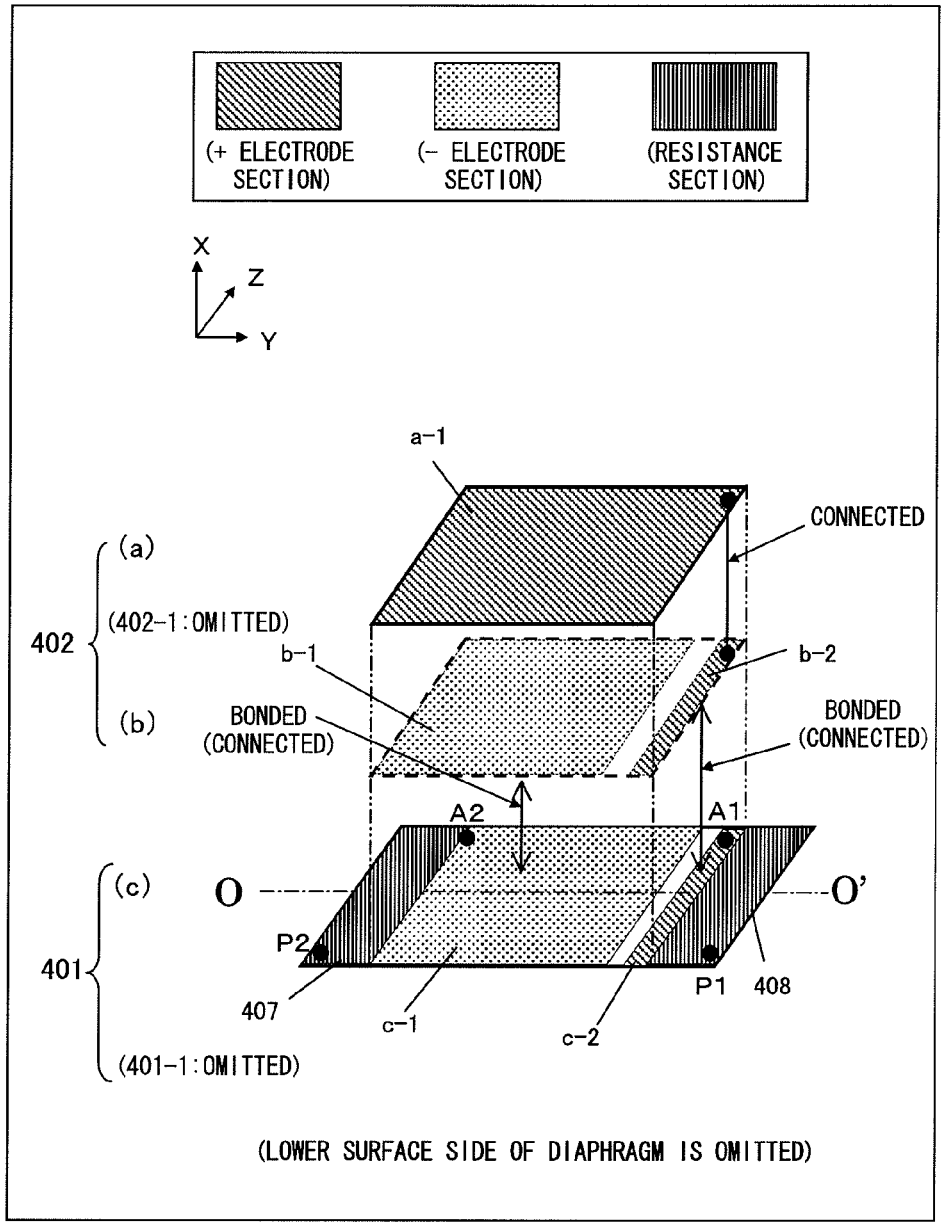
FIG. 10 is a diagrammatic perspective view for describing each electrode layer that constructs the piezoelectric type loudspeaker 400 according to the fourth embodiment of the present invention.

FIG. 10 is a diagrammatic perspective view for describing each electrode layer that constructs the piezoelectric type loudspeaker 400 according to the fourth embodiment. Here, in FIG. 10, the piezoelectric material 402-1 and the substrate 401-1 are omitted. Furthermore, the configuration of the lower surface side of the diaphragm 401 is also omitted. In the following, a layout and connection relationships of electrodes in each of the electrode layers that construct the piezoelectric type loudspeaker 400, are described with reference to FIG. 10.

First, the layout of the electrodes in each of the electrode layers in the piezoelectric type loudspeaker 400 is described with reference to FIG. 10. An electrode a-1 is formed on the electrode layer a. An electrode b-1 and an electrode b-2 are formed on the electrode layer b. The electrodes b-1 and b-2 are electrically insulated from each other. An electrode c-1 and an electrode c-2 are formed on the electrode layer c. The electrode c-1 is integrally formed to, a part that overlaps with the electrode b-1 when viewed from the X-axis direction, and a frame section 404 on one side. Here, in the electrode c-1, a resistance section 407 is formed on the frame section 404 on one side. The electrode c-2 is integrally formed to, a part that overlaps with the electrode b-2 when viewed from the X-axis direction, and another frame section 404 on the other side. Here, in the electrode c-2, a resistance section 408 is formed on the other frame section 404 on the other side. The electrode c-1 and the electrode c-2 do not have any part that makes contact with the other, and are electrically insulated from each other. Furthermore, in FIG. 9, the resistance section 407 and 408 are, as one example, electrical resistances in a thin line form.

Next, the connection relationships of each of the electrodes are described with reference to FIG. 10. Since the electrode layer b and the electrode layer c are bonded to each other, the electrode b-1 and a part of the electrode c-1 corresponding to the electrode b-1 are bonded and electrically connected. Similarly, the electrode b-2 and a part of the electrode c-2 corresponding to the electrode b-2 are bonded and electrically connected.

The electrode a-1 and the electrode b-2 are electrically connected. Means for connecting the electrode a-1 and the electrode b-2 are, for example, through-hole processing and external wiring processing. In (B) of FIG. 9, a connection is attained by applying an external wiring processing that forms wiring on a side surface of the piezoelectric material 402-1.

Figure 11:
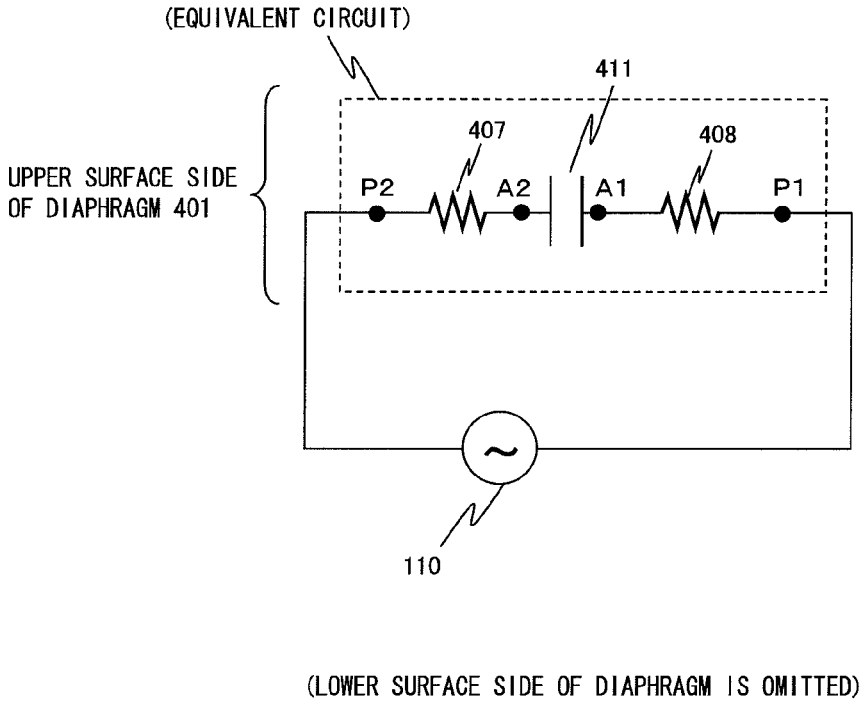
FIG. 11 is a figure showing an equivalent circuit of the piezoelectric type loudspeaker 400 according to the fourth embodiment of the present invention.

FIG. 11 is a figure showing an equivalent circuit of the piezoelectric type loudspeaker 400 according to the fourth embodiment. The equivalent circuit of the piezoelectric type loudspeaker 400 is described in the following with reference to FIG. 10 and FIG. 11. In FIG. 11, the equivalent circuit located on the lower surface side of the diaphragm 401 is omitted. As shown in FIG. 11, the equivalent circuit of the piezoelectric type loudspeaker 400 is a circuit in which a resistance 407 is connected in series with one end of a capacitor 411, and a resistance 408 is connected in series with the other end of the capacitor 411.

In the following, the equivalent circuit in FIG. 11 is described in relation to each of the electrodes in FIG. 10. First, P2 in FIG. 11 corresponds to a point P2 of the resistance section 407 of the electrode c-1 in FIG. 10. The resistance 407 in FIG. 11 corresponds to the resistance section 407 of the electrode c-1 in FIG. 10. A2 in FIG. 11 corresponds to a point A2 of the electrode c-1 in FIG. 10. The capacitor 411 in FIG. 11 corresponds to, in FIG. 10, one part of the electrode a-1, the electrode b-1, and one part of the electrode c-1. More specifically, an electrode on the A2 side of the capacitor 411 in FIG. 11 corresponds to, in FIG. 10, the electrode b-1 and a part that overlaps with the electrode b-1 on the electrode c-1. Furthermore, an electrode on the A1 side of the capacitor 411 in FIG. 11 corresponds to a part that overlaps with the electrode b-1 on the electrode a-1 in FIG. 10. A1 in FIG. 11 corresponds to a point A1 of the electrode c-2 in FIG. 10. The resistance 408 in FIG. 11 corresponds to the resistance section 408 of the electrode c-2 in FIG. 10. P1 in FIG. 11 corresponds to a point P1 of the resistance section 408 of the electrode c-2 in FIG. 10.

As described above, with the piezoelectric type loudspeaker 400 according to the fourth embodiment of the present invention, the resistance, which is connected in series with the piezoelectric element and has a property of a capacitor, is integrally formed to one part of the electrode formed on the diaphragm surface by using a printing technology and the like. By this, it is possible to flatten the sound pressure characteristic without increasing the number of parts, and in addition, attain space-saving.

Furthermore, in the piezoelectric type loudspeaker 400 according to the fourth embodiment of the present invention, because of the same reason described in the first embodiment, the print pattern used for printing the electrodes may be shared for printing the front and rear surfaces of the loudspeaker. As a result, it is possible to reduce manufacturing cost.

Figure 12:
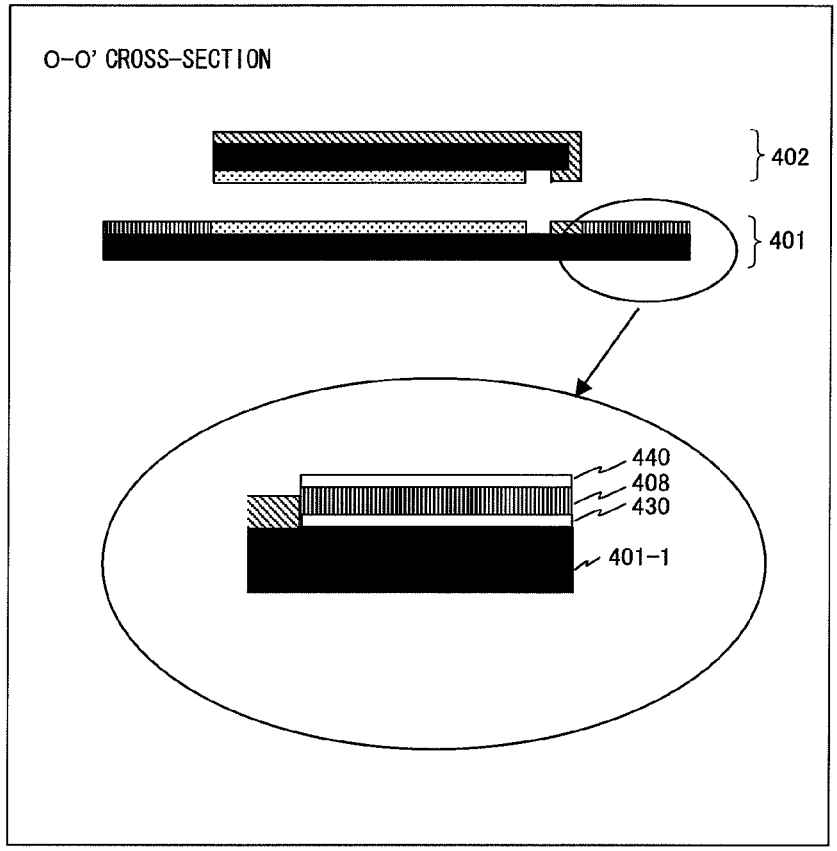
FIG. 12 is an enlarged view of a resistance section of the piezoelectric type loudspeaker 400 according to the fourth embodiment of the present invention.

As shown in FIG. 12, a thermal insulation material 430 may be provided in between the resistance section 408(407) and the substrate 401-1, and a heat dissipating material 440 may be provided on the upper surface of the resistance section 408(407). By this, deformation and change in vibration characteristics of the diaphragm 401, due to heat generation by the resistance section 408(407), can be effectively suppressed. Similar advantageous effect can be obtained for the other embodiments by similarly providing the embodiments with the thermal insulation material and the heat dissipating material.

Figure 13:
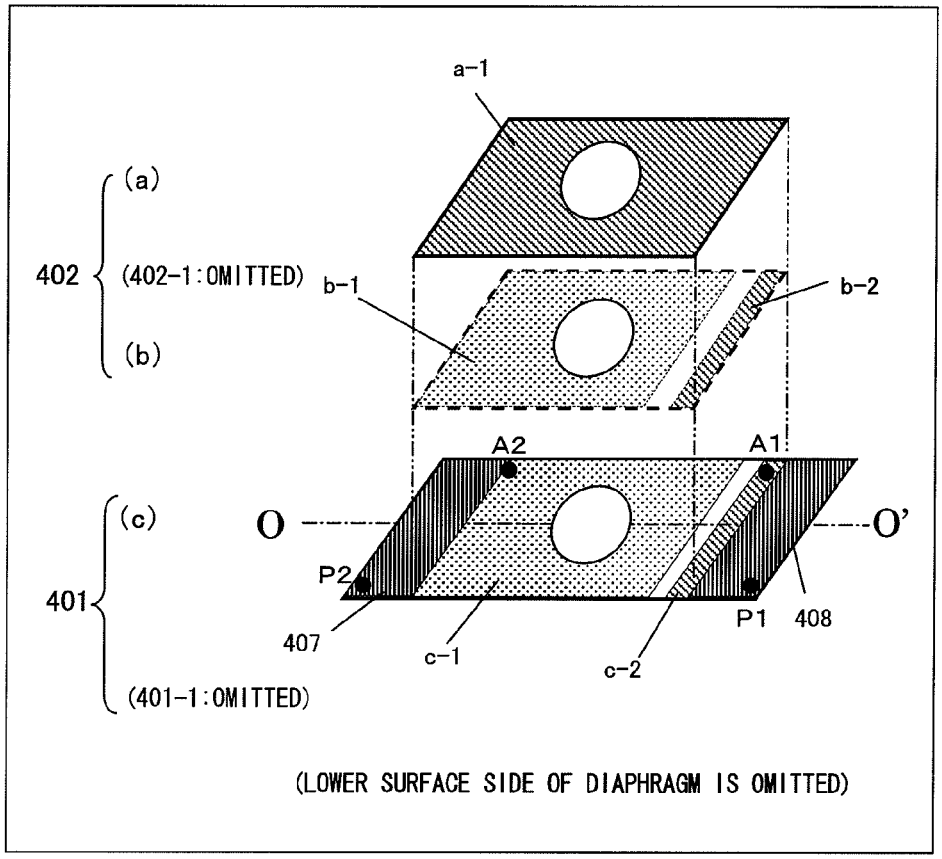
FIG. 13 is a figure in which an electrode-absent part is provided to the piezoelectric type loudspeaker 400 according to the fourth embodiment of the present invention.

Furthermore, as shown in FIG. 13, a part without an electrode (electrode-absent part) may be provided in an internal area of the electrode. By this, the electrode area size can be reduced and power consumption can be suppressed. Furthermore, since the piezoelectric material interposed in between electrode-absent parts can vibrate freely, sound quality can be regulated by an electrode-absent part. Still further, a resonance characteristic of the diaphragm can be regulated by allocating an insulation material to the electrode-absent part and providing the diaphragm with additional mass. Additionally, the resonance characteristic of the diaphragm can also be regulated by allocating a material with a high vibration-decaying characteristic to the electrode-absent part. Similar advantageous effect can be obtained for the other embodiments by similarly providing the embodiments with the electrode-absent part.

Fifth Embodiment

In addition to the characteristics of the piezoelectric type loudspeaker 400 according to the fourth embodiment, a piezoelectric type loudspeaker 500 according to a fifth embodiment has a characteristic in which an electrode of a piezoelectric element is split plurally, and an electrode connected to a resistance in series and an electrode not connected to a resistance are provided. Description centered on this characteristic is given in the following, and descriptions of characteristics in common with the piezoelectric type loudspeaker 400 according to the fourth embodiment are omitted in principle. As a footnote, descriptions with reference to a top view and a cross sectional view of the piezoelectric type loudspeaker 500 are omitted for the fifth embodiment. Additionally, description of the configuration of the lower surface side of the diaphragm is omitted in the following.

Figure 14:
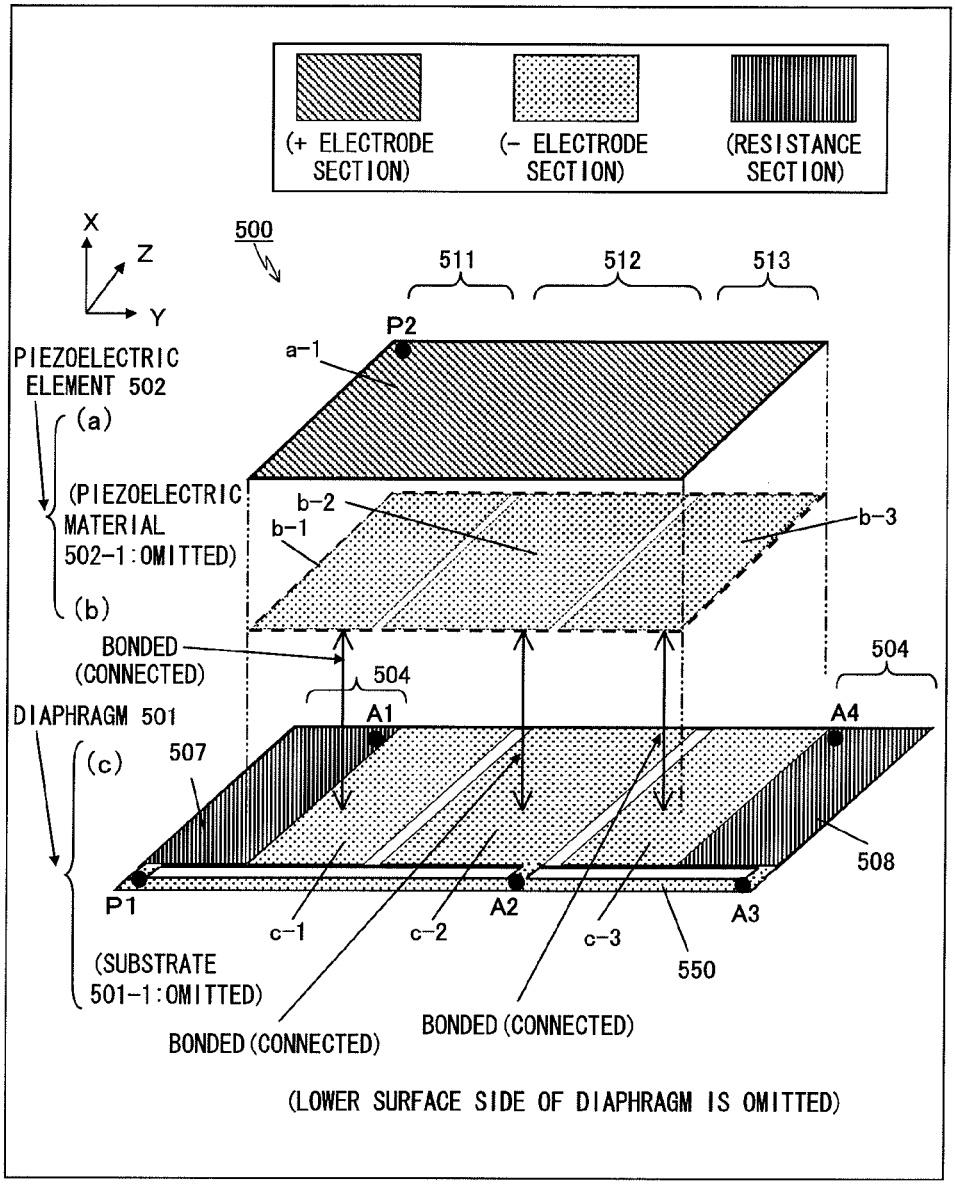
FIG. 14 is a diagrammatic perspective view for describing each electrode layer that constructs a piezoelectric type loudspeaker 500 according to a fifth embodiment of the present invention.

FIG. 14 is a diagrammatic perspective view for describing each electrode layer that constructs the piezoelectric type loudspeaker 500 according to the fifth embodiment. Here, in FIG. 14: a piezoelectric material 502-1 which is a component of a piezoelectric element 502 is omitted; a substrate 501-1 which is a component of a diaphragm 501 is omitted; and the configuration of the lower surface side of the diaphragm 501 is also omitted. In the following, a layout and connection relationships of electrodes in each of the electrode layers that construct the piezoelectric type loudspeaker 500, are described with reference to FIG. 14.

First, the layout of the electrodes in each of the electrode layers in the piezoelectric type loudspeaker 500 is described with reference to FIG. 14. An electrode a-1 is formed on an electrode layer a. An electrode b-1, an electrode b-2, and an electrode b-3 are formed on an electrode layer b. The electrodes b-1 to b-3 are electrically insulated from each other. An electrode c-1, an electrode c-2, and an electrode c-3 are formed on an electrode layer c. The electrode c-1 is integrally formed to, a part that overlaps with the electrode b-1 when viewed from the X-axis direction, and a frame section 504 on one side of the diaphragm 501. In addition, a resistance section 507 is formed on a part on one side of the frame section 504 in the electrode c-1. The electrode c-2 is formed on a part that overlaps with the electrode b-2 when viewed from the X-axis direction. The electrode c-3 is integrally formed to, a part that overlaps with the electrode b-3 when viewed from the X-axis direction, and another frame section 504 on the other end of the diaphragm 501. In addition, a resistance section 508 is formed on a part on the other end of the frame section 504 in the electrode c-3. Furthermore, the resistance section 507 of the electrode c-1, the electrode c-2, and the resistance section 508 of the electrode c-3 are connected to a surface of the substrate 501-1 through a wiring electrode 550.

Next, the connection relationships of each of the electrodes are described with reference to FIG. 14. Since the electrode layer b and the electrode layer c are bonded to each other, the electrode b-1 and a part of the electrode c-1 corresponding to the electrode b-1 are bonded and electrically connected. Moreover, the electrode c-2 and the electrode b-2 are bonded and electrically connected. Furthermore, the electrode b-3 and a part of the electrode c-3 corresponding to the electrode b-3 are bonded and electrically connected.

Figure 15:
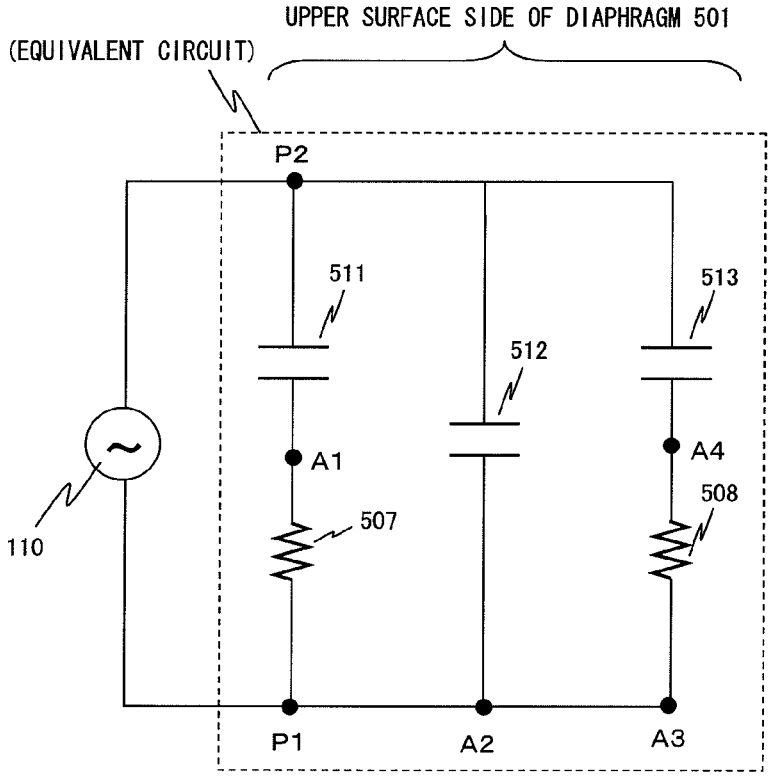
FIG. 15 is a figure showing an equivalent circuit of the piezoelectric type loudspeaker 500 according to the fifth embodiment of the present invention.

FIG. 15 is a figure showing an equivalent circuit of the piezoelectric type loudspeaker 500 according to the fifth embodiment. The equivalent circuit of the piezoelectric type loudspeaker 500 is described in the following with reference to FIG. 14 and FIG. 15. In FIG. 15, the equivalent circuit located on the lower surface side of the diaphragm 501 is omitted. As shown in FIG. 15, the equivalent circuit of the piezoelectric type loudspeaker 500 is a circuit constructed by parallelly connecting: an RC circuit in which a capacitor 511 and a resistance 507 are connected in series; a capacitor 512; and an RC circuit in which a capacitor 513 and a resistance 508 are connected in series.

In the following, the equivalent circuit in FIG. 15 is described in relation to each of the electrodes in FIG. 14. First, P1 in FIG. 15 corresponds to a point P1 of the wiring electrode 550 in FIG. 14. The resistance 507 in FIG. 15 corresponds to the resistance section 507 in FIG. 14. A1 in FIG. 15 corresponds to a point A1 of the resistance section 507 on the electrode c-1 in FIG. 14. The capacitor 511 in FIG. 15 corresponds to, in FIG. 14, one part of the electrode c-1, the electrode b-1, and one part of the electrode a-1. More specifically, an electrode on the A1 side of the capacitor 511 in FIG. 15 corresponds to, in FIG. 14, a part that overlaps with the electrode b-1 on the electrode c-1, and the electrode b-1. Furthermore, an electrode on the P2 side of the capacitor 511 in FIG. 15 corresponds to a part that overlaps with the electrode b-1 on the electrode a-1 in FIG. 14.

A2 in FIG. 15 corresponds to a point A2 of the wiring electrode 550 in FIG. 14. The capacitor 512 in FIG. 15 corresponds to, in FIG. 14, the electrode c-2, the electrode b-2, and one part of the electrode a-1. More specifically, an electrode on the A2 side of the capacitor 512 in FIG. 15 corresponds to, in FIG. 14, the electrode c-2 and the electrode b-1. Furthermore, an electrode on the P2 side of the capacitor 512 in FIG. 15 corresponds to a part that overlaps with the electrode b-2 on the electrode a-1 in FIG. 14.

A3 in FIG. 15 corresponds to a point A3 of the wiring electrode 550 in FIG. 14. The resistance 508 in FIG. 15 corresponds to the resistance section 508 in FIG. 14. A4 in FIG. 15 corresponds to a point A4 of the resistance section 508 on the electrode c-3 in FIG. 14. The capacitor 513 in FIG. 15 corresponds to, in FIG. 14, one part of the electrode c-3, the electrode b-3, and one part of the electrode a-1. More specifically, an electrode on the A4 side of the capacitor 513 in FIG. 15 corresponds to, in FIG. 14, a part that overlaps with the electrode b-3 on the electrode c-3, and the electrode b-3. Furthermore, an electrode on the P2 side of the capacitor 513 in FIG. 15 corresponds to a part that overlaps with the electrode b-3 on the electrode a-1 in FIG. 14.

As described above, in addition to the characteristics of the piezoelectric type loudspeaker 400 according to the fourth embodiment, the piezoelectric type loudspeaker 500 according to the fifth embodiment of the present invention has the characteristic in which the electrode of the piezoelectric element is split plurally, and the electrode connected to the resistance in series and the electrode not connected to a resistance are provided. As a result, in addition to the advantageous effect of the piezoelectric type loudspeaker 400 according to the fourth embodiment, according to the piezoelectric type loudspeaker 500, the sound pressure characteristic can be flat only in one part of an area of the piezoelectric element (an area where the resistance is connected in series). For example, by not connecting a resistance to a split electrode in the central area of the piezoelectric element and connecting a resistance to split electrode in the peripheral area of the piezoelectric element, sounds in the low frequency range can be driven in the whole area of the piezoelectric element, on the other hand, sounds in the high frequency range can be driven only in the central part of the piezoelectric element. Thus, according to the piezoelectric type loudspeaker 500, a two-way loudspeaker can be attained by a single layer of the piezoelectric element.

Figure 16:
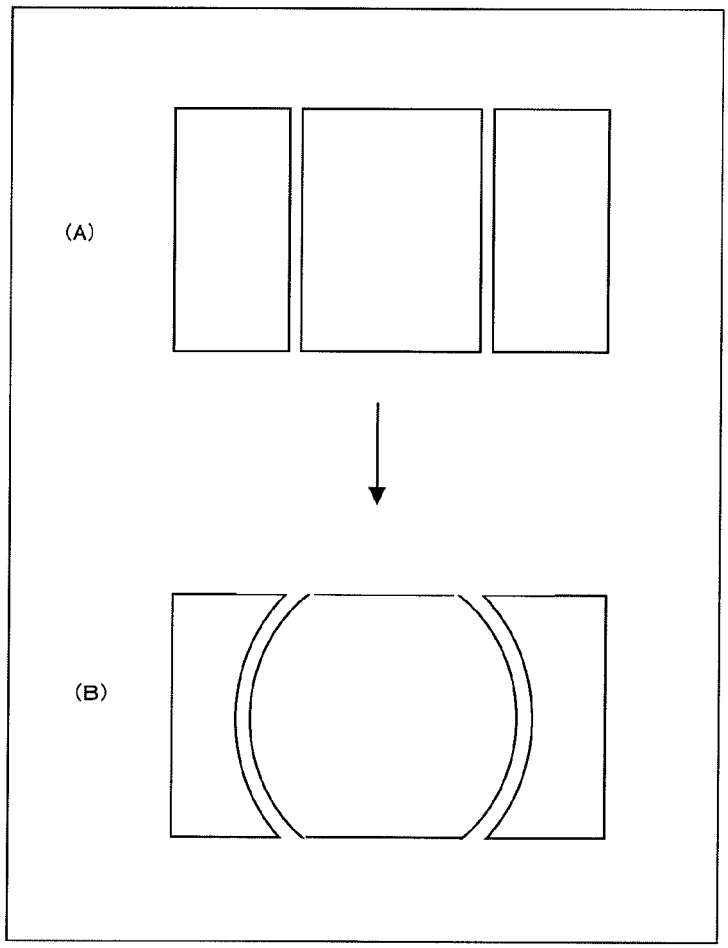
FIG. 16 is a figure for describing a shape of a split electrode in the piezoelectric type loudspeaker 500 according to the fifth embodiment of the present invention.

Since the split electrode of the piezoelectric element can have an arbitrary shape: the electrode may be split, for example, in a shape indicated in (A) of FIG. 16; or the electrode may be split, for example, in a shape indicated in (B) of FIG. 16. The vibration characteristics of the diaphragm can be regulated by properly configuring the shape of the electrode to be split as described above. Furthermore, the vibration characteristics of the diaphragms in the second, the third, and the sixth embodiment can also be similarly regulated by properly configuring the shape of the electrode to be split.

In addition, in the description above, the vibration characteristics is regulated by whether or not a resistance is connected to the split electrode. However, the vibration characteristics may be properly regulated further by regulating a value of the resistance connected to the split electrode.

Sixth Embodiment

In addition to the characteristics of the piezoelectric type loudspeaker 400 according to the fourth embodiment, a piezoelectric type loudspeaker 600 according to a sixth embodiment has a characteristic in which an electrode of a piezoelectric element is split plurally, and a reverse voltage is applied to one part of the electrode. Description centered on this characteristic is given in the following, and descriptions of characteristics in common with the piezoelectric type loudspeaker 400 according to the fourth embodiment are omitted in principle. As a footnote, descriptions with reference to a top view and a cross sectional view of the piezoelectric type loudspeaker 600 are omitted for the sixth embodiment. Additionally, description of the configuration of the lower surface side of the diaphragm is omitted in the following.

Figure 17:
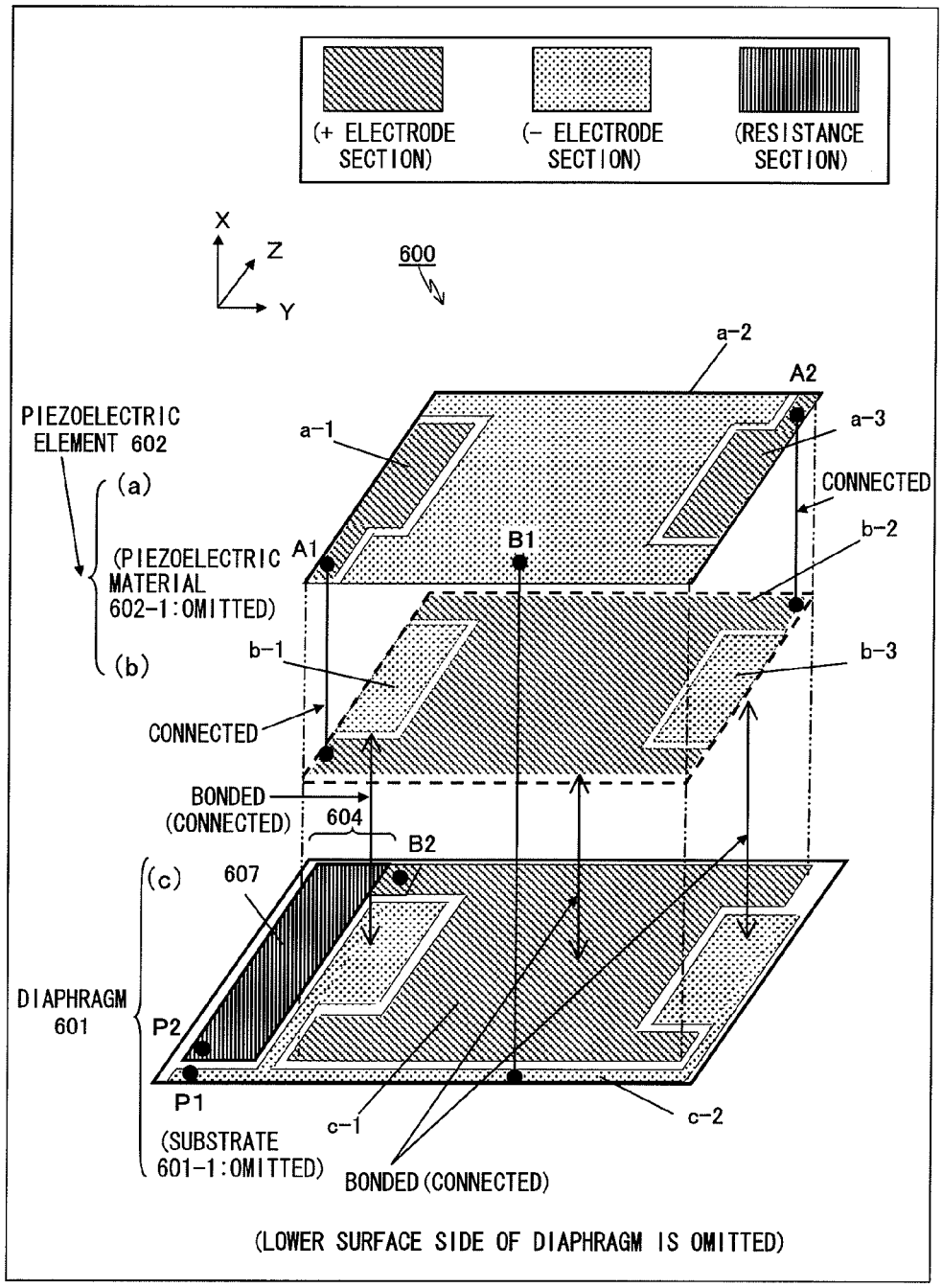
FIG. 17 is a diagrammatic perspective view for describing each electrode layer that constructs a piezoelectric type loudspeaker 600 according to a sixth embodiment of the present invention.

FIG. 17 is a diagrammatic perspective view for describing each electrode layer that constructs the piezoelectric type loudspeaker 600 according to the sixth embodiment. Here in, FIG. 17: a piezoelectric material 602-1 which is a component of a piezoelectric element 602 is omitted; a substrate 601-1 which is a component of a diaphragm 601 is omitted; and the configuration of the lower surface side of the diaphragm 601 is also omitted. In the following, a layout and connection relationships of electrodes in each of the electrode layers that construct the piezoelectric type loudspeaker 600, are described with reference to FIG. 17.

First, the layout of the electrodes in each of the electrode layers in the piezoelectric type loudspeaker 600 is described. An electrode a-1, an electrode a-2, and an electrode a-3 are formed on an electrode layer a. The electrodes a-1 to a-3 are electrically insulated from each other. An electrode b-1, an electrode b-2, and an electrode b-3 are formed on an electrode layer b. The electrodes b-1 to b-3 are electrically insulated from each other. An electrode c-1 and an electrode c-2 are formed on an electrode layer c. The electrode c-1 is integrally formed to, a part that overlaps with the electrode b-2 when viewed from the X-axis direction, and a frame section 604 of the diaphragm 601. Furthermore, a resistance section 607 is formed on the frame section 604 in the electrode c-1. The electrode c-2 is integrally formed to, a part that overlaps with the electrode b-1 when viewed from the X-axis direction, and a part that overlaps with the electrode b-3 when viewed from the X-axis direction, via a wiring electrode part. The electrode c-1 and the electrode c-2 do not have any part that makes contact with the other, and are electrically insulated from each other.

Next, the connection relationships of each of the electrodes are described. Since the electrode layer b and the electrode layer c are bond to each other, the electrode b-2 and a part of the electrode c-1 corresponding to the electrode b-2 are bonded and electrically connected. Furthermore, the electrode b-1 and a part of the electrode c-2 corresponding to the electrode b-1 are bonded and electrically connected. Similarly, the electrode b-3 and a part of the electrode c-2 corresponding to the electrode b-3 are bonded and electrically connected.

The electrode a-1 and the electrode b-2 are electrically connected. Similarly, the electrode a-3 and the electrode b-2 are electrically connected. Furthermore, the electrode a-2 and the electrode c-2 are electrically connected. Means for attaining these connections are, for example, through-hole processing and external wiring processing.

Figure 18:
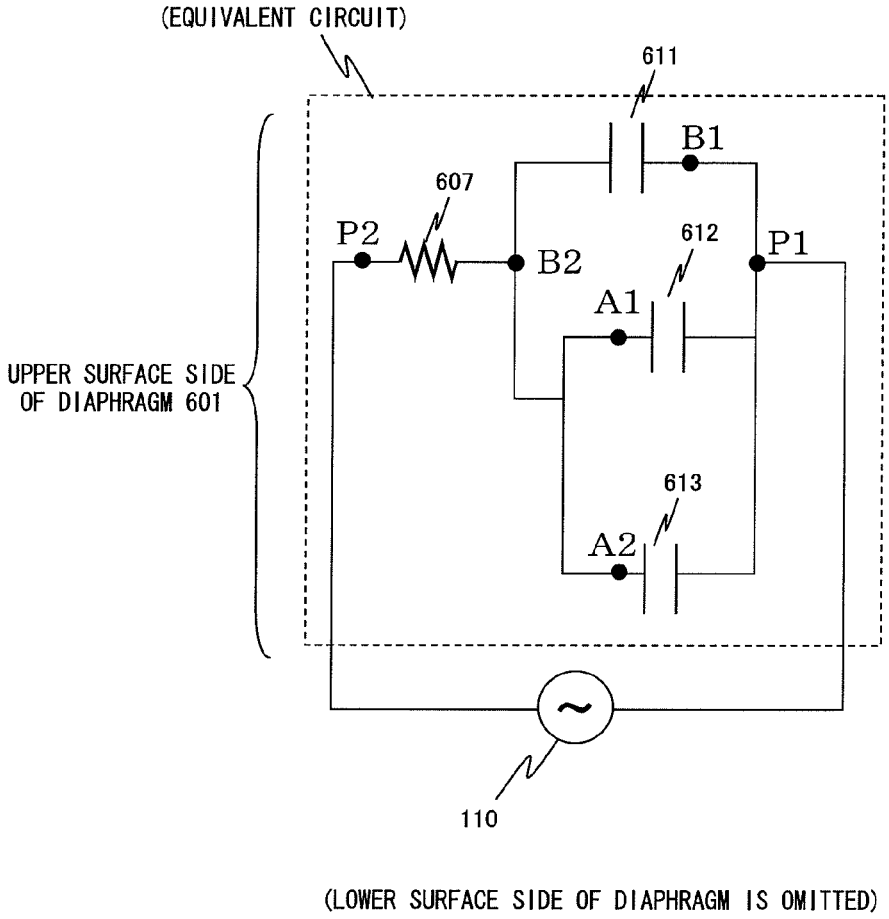
FIG. 18 is a figure showing an equivalent circuit of the piezoelectric type loudspeaker 600 according to the sixth embodiment of the present invention.

FIG. 18 is a figure showing an equivalent circuit of the piezoelectric type loudspeaker 600 according to the sixth embodiment. The equivalent circuit of the piezoelectric type loudspeaker 600 is described in the following with reference to FIG. 17 and FIG. 18. In FIG. 18, the equivalent circuit located on the lower surface side of the diaphragm 601 is omitted. As shown in FIG. 18, the equivalent circuit of the piezoelectric type loudspeaker 600 is a circuit in which a resistance 607 is connected in series with another circuit that is constructed by parallelly connecting a capacitor 611, a capacitor 612, and a capacitor 613.

In the following, the equivalent circuit in FIG. 18 is described in relation to each of the electrodes in FIG. 17. First, P2 in FIG. 18 corresponds to a point P2 of the resistance section 607 of the electrode c-1 in FIG. 17. The resistance 607 in FIG. 18 corresponds to the resistance section 607 in FIG. 17. B2 in FIG. 18 corresponds to a point B2 of the electrode c-1 in FIG. 17. The capacitor 611 in FIG. 18 corresponds to, in FIG. 17, one part of the electrode c-1 and electrode b-2. More specifically, an electrode on the B2 side of the capacitor 611 in FIG. 18 corresponds to, in FIG. 17, a part that overlaps with the electrode b-2 on the electrode c-1, and the electrode b-2. Furthermore, an electrode on the B1 side of the capacitor 611 in FIG. 18 corresponds to the electrode a-2 in FIG. 17. B1 in FIG. 18 corresponds to a point B1 of the electrode a-2 in FIG. 17. P1 in FIG. 18 corresponds to a point P1 of the wiring electrode part on the electrode c-2 in FIG. 17.

A1 in FIG. 18 corresponds to a point A1 of the electrode a-1 in FIG. 17. The capacitor 612 in FIG. 18 corresponds to, in FIG. 17, one part of the electrode c-2, the electrode b-1, and the electrode a-1. More specifically, an electrode on the A1 side of the capacitor 612 in FIG. 18 corresponds to the electrode a-1 in FIG. 17. Furthermore, an electrode on the P1 side of the capacitor 612 in FIG. 18 corresponds to, in FIG. 17, the electrode b-1, and a part that overlaps with the electrode b-1 on the electrode c-2.

A2 in FIG. 18 corresponds to a point A2 of the electrode a-3 in FIG. 17. The capacitor 613 in FIG. 18 corresponds to, in FIG. 17, one part of the electrode c-2, the electrode b-3, and the electrode a-3. More specifically, an electrode on the A2 side of the capacitor 613 in FIG. 18 corresponds to the electrode a-3 in FIG. 17. Furthermore, an electrode on the P1 side of the capacitor 613 in FIG. 18 corresponds to, in FIG. 17, the electrode b-3, a part that overlaps with the electrode b-3 on the electrode c-2.

As described above, in addition to the characteristics of the piezoelectric type loudspeaker 400 according to the fourth embodiment, the piezoelectric type loudspeaker 600 according to the sixth embodiment of the present invention has the characteristic in which the electrode of the piezoelectric element is split plurally, and a reverse voltage is given applied to one part of the electrode. As a result, in addition to the advantageous effect of the piezoelectric type loudspeaker 400 according to the fourth embodiment, according to the piezoelectric type loudspeaker 600, an unnecessary vibrational mode that is generated on the diaphragm can be effectively cancelled out.

Seventh Embodiment

A piezoelectric type loudspeaker 700 according to a seventh embodiment differs from the piezoelectric type loudspeaker 100 according to the first embodiment, in a point that an electrode of the piezoelectric element is split, and in another point that a resistance is connected in a different connection format. In the following, descriptions are centered on these different points, and descriptions of points in common with the piezoelectric type loudspeaker 100 according to the first embodiment are omitted in principle.

Figure 19:
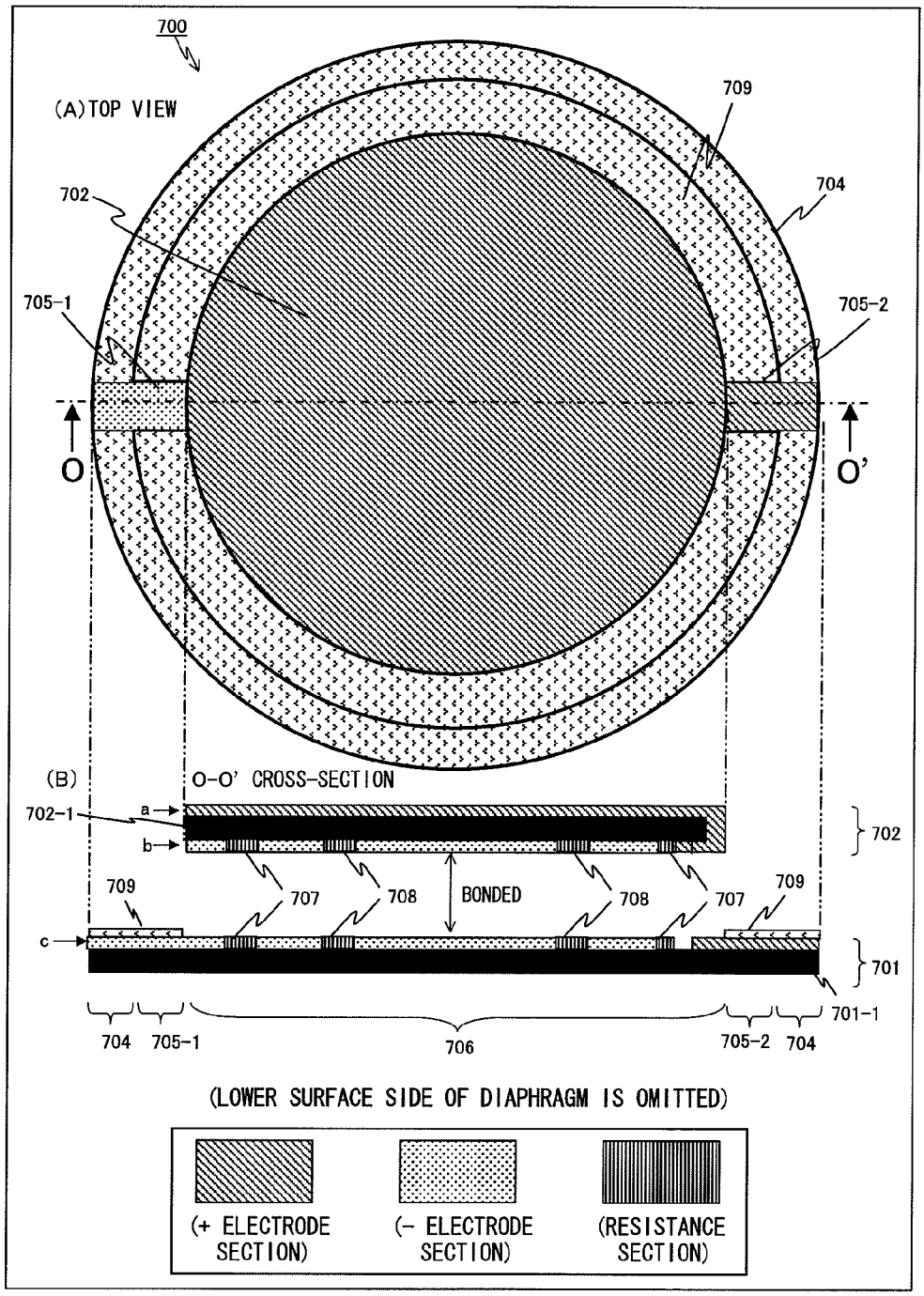
FIG. 19 is a top view and a cross sectional view of one example of a piezoelectric type loudspeaker 700 according to a seventh embodiment of the present invention.

FIG. 19 is a top view and a cross sectional view of one example of the piezoelectric type loudspeaker 700 according to the seventh embodiment. In FIG. 19, (A) is a top view, and (B) is a cross-sectional view of O-O'. As shown in FIG. 19, the piezoelectric type loudspeaker 700 includes: a diaphragm 701; a piezoelectric element 702; a piezoelectric element 703; and a filler 709. Here, the configuration of the lower surface side of the diaphragm 701 is omitted for convenience of description in FIG. 19. Thus the piezoelectric element 703 is not graphically represented. Furthermore, in the following, the description of the configuration of the lower surface side of the diaphragm 701 is omitted. Still further, in FIG. 19, the diaphragm 701 and the piezoelectric element 702 are illustrated separately for convenience of description; however, in practice, the diaphragm 701 and the piezoelectric element 702 are bonded to each other.

The piezoelectric element 702 includes: a piezoelectric material 702-1; the electrode layer a formed on the upper surface of the piezoelectric material 702-1; and the electrode layer b formed on the lower surface of the piezoelectric material 702-1 (refer (B) of FIG. 19).

The diaphragm 701 includes: a substrate 701-1; and an electrode layer c formed on the upper surface of the substrate 701-1. When classified functionally, the diaphragm 701 includes: a frame section 704; supporting sections 705-1 and 705-2; and a vibrating section 706 ((B) of FIG. 19).

The filler 709 fills gaps among the frame section 704, the supporting sections 705-1 and 705-2, and the vibrating section 706. Furthermore, the filler 709 is also applied on the surfaces of the frame section 704 and the supporting sections 705-1 and 705-2.

Figure 20:
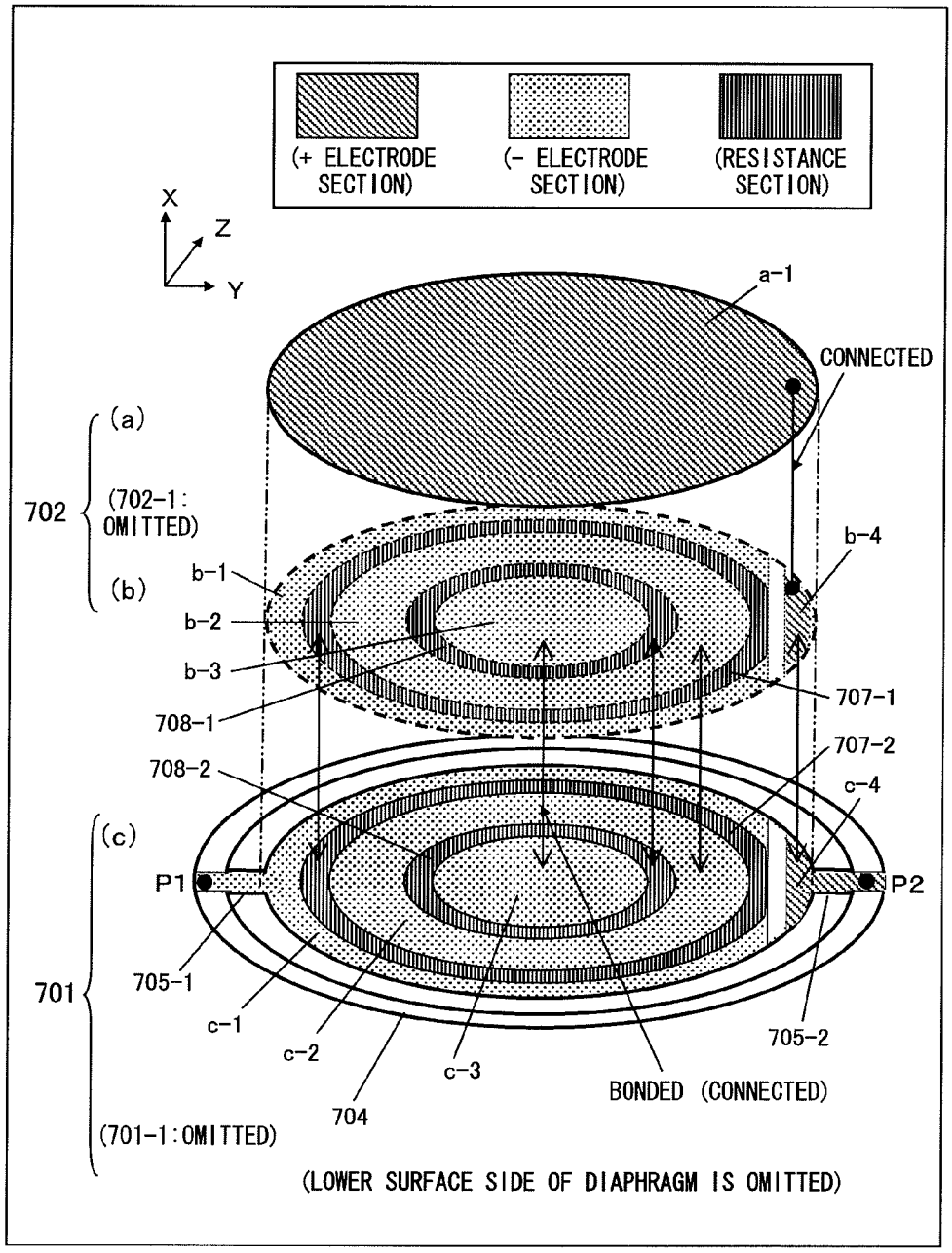
FIG. 20 is a diagrammatic perspective view for describing each electrode layer that constructs the piezoelectric type loudspeaker 700 according to the seventh embodiment of the present invention.

FIG. 20 is a diagrammatic perspective view for describing each electrode layer that constructs the piezoelectric type loudspeaker 700 according to the seventh embodiment. Here, in FIG. 20, the piezoelectric material 702-1 and the substrate 701-1 are omitted. Furthermore, the configuration of the lower surface side of the diaphragm 701 is also omitted. In the following, a layout and connection relationships of electrodes in each of the electrode layers that construct the piezoelectric type loudspeaker 700, are described with reference to FIG. 20.

First, the layout of the electrodes in each of the electrode layers in the piezoelectric type loudspeaker 700 is described. An electrode a-1 is formed on an electrode layer a. An electrode b-1, an electrode b-2, an electrode b-3, and an electrode b-4 are formed on the electrode layer b. In the electrode layer b: a resistance section 707-1 is formed in between the electrode b-1 and the electrode b-2; and a resistance section 708-1 is formed in between the electrode b-2 and the electrode b-3. The electrode b-4 is, since it is a wiring electrode, electrically insulated from the electrode b-1, the electrode b-2, the electrode b-3, the resistance section 707-1, and the resistance section 708-1. An electrode c-1, an electrode c-2, an electrode c-3, and an electrode c-4 are formed on an electrode layer c. The electrode c-1 is integrally formed to, a part that overlaps with the electrode b-1 when viewed from the X-axis direction, a supporting section 705-1 of the diaphragm 701, and one part of the frame section 704. The electrode c-2 is formed on a part that overlaps with the electrode b-2 when viewed from the X-axis direction. The electrode c-3 is formed on a part that overlaps with the electrode b-3 when viewed from the X-axis direction. The electrode c-4 is integrally formed to, a part that overlaps with the electrode b-4 when viewed from the X-axis direction, a supporting section 705-2 of the diaphragm 701, and one part of the frame section 704. A resistance section 707-2 is formed on a part that overlaps with the resistance section 707-1 when viewed from the X-axis direction. A resistance section 708-2 is formed on a part that overlaps with the resistance section 708-1 when viewed from the X-axis direction.

Next, the connection relationships of each of the electrodes are described. Since the electrode layer b and the electrode layer c are bonded to each other, the electrode b-1 and a part of the electrode c-1 corresponding to the electrode b-1 are bonded and electrically connected. The electrode c-2 and the electrode b-2 are bonded and electrically connected. The electrode c-3 and the electrode b-3 are bonded and electrically connected. The electrode b-4 and a part of the electrode c-4 corresponding to the electrode b-4 are bonded and electrically connected. Furthermore, the resistance section 707-1 and the resistance section 707-2 are bonded and electrically connected. Similarly, the resistance section 708-1 and the resistance section 708-2 are bonded and electrically connected.

The electrode a-1 and the electrode b-4 are electrically connected. Means for attaining this connection are, for example, through-hole processing and external wiring processing.

Figure 21:
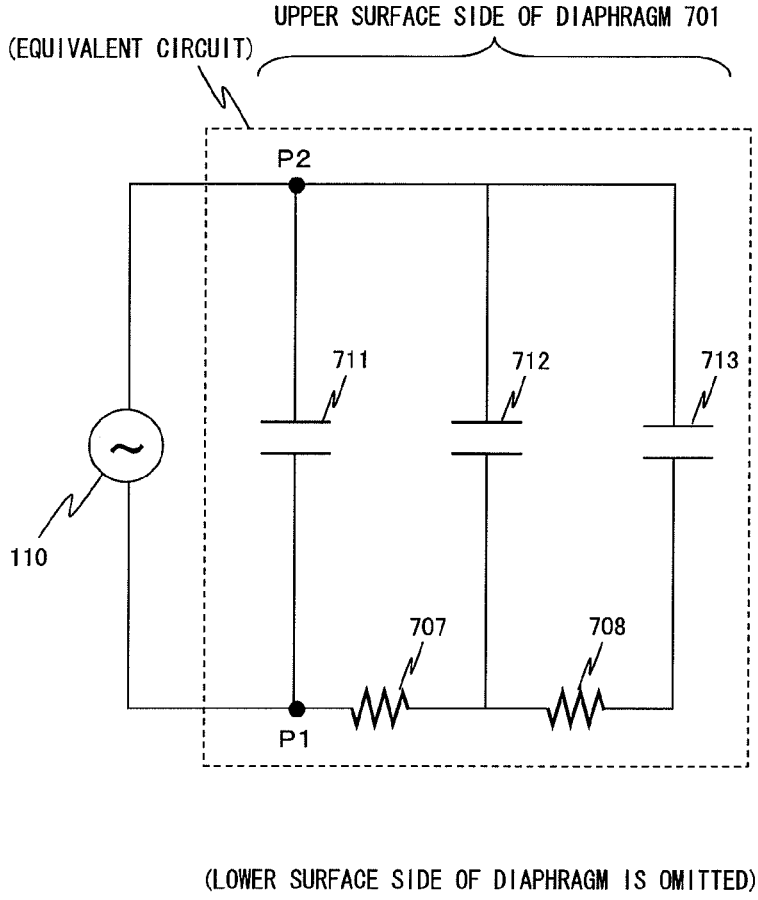
FIG. 21 is a figure showing an equivalent circuit of the piezoelectric type loudspeaker 700 according to the seventh embodiment of the present invention.

FIG. 21 is a figure showing an equivalent circuit of the piezoelectric type loudspeaker 700 according to the seventh embodiment. The equivalent circuit of the piezoelectric type loudspeaker 700 is described in the following with reference to FIG. 20 and FIG. 21. In FIG. 21, the equivalent circuit located on the lower surface side of the diaphragm 701 is omitted. As shown in FIG. 21, the equivalent circuit of the piezoelectric type loudspeaker 700 is a circuit constructed by: parallelly connecting a capacitor 711, a capacitor 712, and a capacitor 713; inserting a resistance 707 to one end that connects the capacitor 711 and the capacitor 712; and inserting a resistance 708 to one end that connects the capacitor 712 and the capacitor 713. This equivalent circuit is connected to the alternating-current power supply 110.

In the following, the equivalent circuit in FIG. 21 is described in relation to each of the electrodes in FIG. 20. First, P1 in FIG. 21 corresponds to a point P1 of the electrode c-1 in FIG. 20. The capacitor 711 in FIG. 21 corresponds to, in FIG. 20, one part of the electrode a-1, the electrode b-1, and one part of the electrode c-1. More specifically, an electrode on the P1 side of the capacitor 711 in FIG. 21 corresponds to, in FIG. 20, a part that overlaps with the electrode b-1 on the electrode c-1, and the electrode b-1. An electrode on the P2 side of the capacitor 711 in FIG. 21 corresponds to a part that overlaps with the electrode b-1 on the electrode a-1 in FIG. 20. The resistance 707 in FIG. 21 corresponds to, in FIG. 20, the resistance section 707-1 and the resistance section 707-2. The capacitor 712 in FIG. 21 corresponds to, in FIG. 20, one part of the electrode a-1, the electrode b-2, and the electrode c-2. More specifically, an electrode on the P1 side of the capacitor 712 in FIG. 21 corresponds to, in FIG. 20, the electrode c-2 and the electrode b-2. An electrode on the P2 side of the capacitor 712 in FIG. 21 corresponds to a part that overlaps with the electrode b-2 on the electrode a-1 in FIG. 20. The resistance 708 in FIG. 21 corresponds to, in FIG. 20, the resistance section 708-1 and the resistance section 708-2. The capacitor 713 in FIG. 21 corresponds to, in FIG. 20, one part of the electrode a-1, the electrode b-3, and the electrode c-3. More specifically, an electrode on the P1 side of the capacitor 713 in FIG. 21 corresponds to, in FIG. 20, the electrode c-3 and the electrode b-3. An electrode on the P2 side of the capacitor 713 in FIG. 21 corresponds to a part that overlaps with the electrode b-3 on the electrode a-1 in FIG. 20.

As described above, the piezoelectric type loudspeaker 700 according to the seventh embodiment of the present invention includes a multistage filter described with reference to FIG. 21. Therefore, according to the piezoelectric type loudspeaker 700, the closer an electrode is allocated toward the center of the electrode layer, the more a sound pressure at the high frequency range is suppressed. As a result, the piezoelectric type loudspeaker 700 according to the seventh embodiment of the present invention can attain a piezoelectric type loudspeaker in which different driving areas of the piezoelectric element are used depending on the frequency range that is played.

In the seventh embodiment, the electrodes and the resistance sections are formed on areas of the electrode layers that have been split along concentrical circles. However, the shape of the electrodes and the resistance sections are not limit to the above described form, and, for example, may have a deformed circular shape. Furthermore, the electrodes and the resistance sections may have a shape where one part of the circular part is interrupted.

Furthermore, in the seventh embodiment, a case, where the electrode in the most outer lining is connected with an external terminal, is used as one example. Nevertheless, an inner lining electrode may be connected to the external terminal. Specifically, the inner lining electrode may be connected with the external terminal by: adopting a shape, where one part of the circular shape is interrupted, as electrode shapes in the outer linings; and laying a wiring part, which is an extension of the inner lining electrode to be connected with the external terminal, through this interrupted part. In this case, the further in the outer linings an electrode is allocated, the more a sound pressure at the high frequency range is suppressed.

Furthermore, in the embodiments described above, each of the electrodes are distinguished and described as + electrode section and – electrode section for convenience of description (refer FIG. 1 and the like). However, as already described, since the piezoelectric type loudspeaker of the present invention is driven by using an alternating-current power supply, this distinction is just for the sake of convenience and + and – may be switched.

Furthermore, in the embodiments described above, the resistance section may be formed of a material having a high electrical resistance value than the electrode section, or may be constructed of the identical material used for the electrode section. In addition, the layer thickness of the resistance section may be thinner than the layer thickness of the electrode section. Moreover, the resistance section may be constructed of a resistance having a thin line form.

Furthermore, the substrate and the electrode layer may be bonded with an adhesive. Similarly, the piezoelectric material and the electrode layer may be bonded with an adhesive.

Furthermore, in the embodiments described above, a case has been described, where the piezoelectric element is mounted on both sides of the diaphragm. However, the piezoelectric element may be mounted to only one surface of the diaphragm.

Furthermore, in the embodiments described above, the electrode layer is provided on both sides of the piezoelectric element. However, among the electrode layers of the piezoelectric element, the electrode layer on the diaphragm side may be utilized also as the electrode layer on the diaphragm surface.

Furthermore, in the embodiments described above, examples have been described where the electrode and the resistance section, which are components of the piezoelectric element, are used to construct the RC circuit. Here, by regulating a resistance value of the resistance section, electrical characteristics of the RC circuit can be configured and equalizer characteristics can be attained. Additionally, characteristics of the RC circuit may be regulated by integrally forming a thin film capacitor to the electrode layer of the diaphragm. Moreover, a LRC circuit may be configured by integrally forming a coil to the electrode layer of the diaphragm. As described above, the desired equalizer characteristics can be easily attained with the loudspeaker itself by additionally forming electric circuit elements to the electrode layer of the diaphragm.

Furthermore, in the first to third embodiments, a case, where the resistance section is formed on the frame section, is described as an example. However, in the first to third embodiments, the resistance section may be formed on the supporting section, or may be formed on both the supporting section and the frame section.

Furthermore, in the embodiments described above, the electrode (including the resistance section) formed on the diaphragm surface (principal surface) is preferably formed by print wiring. Methods for forming the print wiring are, for example, a method in which screen-printing is conducted, a method in which an electrode layer fixed and formed on the diaphragm is etched, and a method in which a metal plate is etched and then attached to the diaphragm. Moreover, the electrode that constructs the piezoelectric element may be referred to as a surface electrode.

Furthermore, in the embodiments described above, the resistance section may be formed, for example, from either an alloy, a resin, or a composite material of a metal and a resin.

Eighth Embodiment

In an eighth embodiment, an example is described of an application of the piezoelectric type loudspeaker of the present invention described above.

First Example of Application

Figure 22:
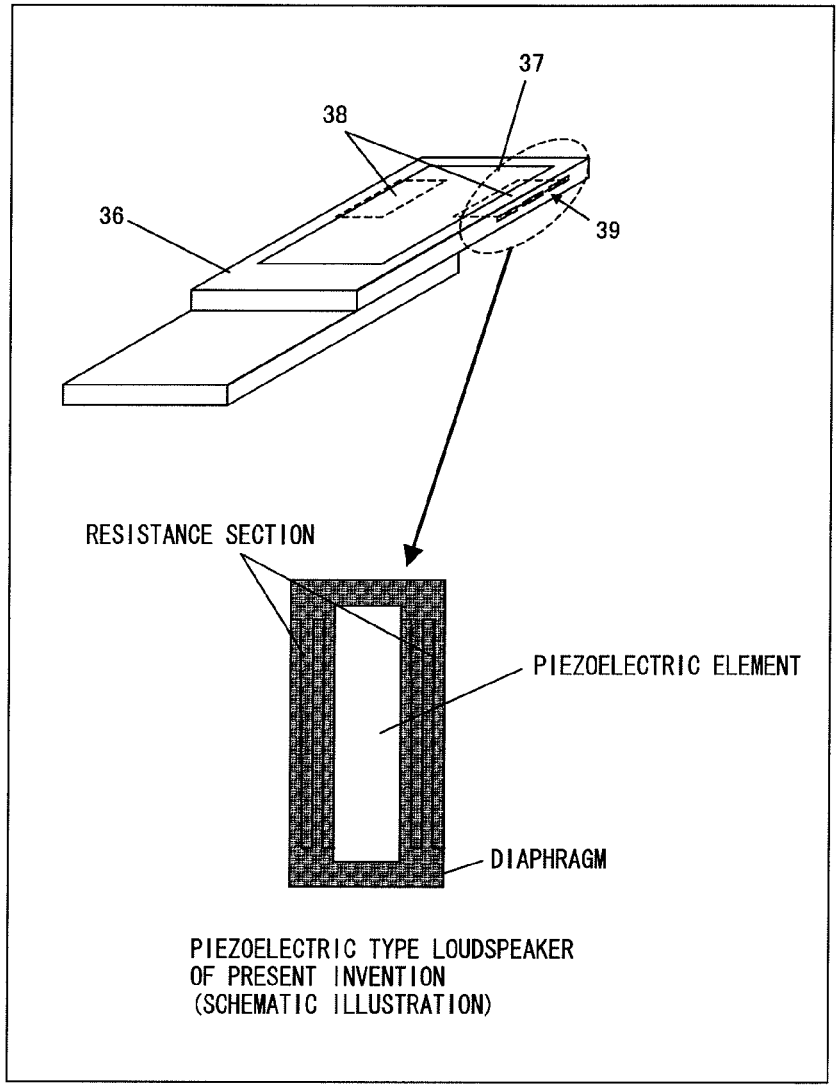
FIG. 22 is one example of an exterior view of a mobile telephone terminal in which the piezoelectric type loudspeaker of the present invention is applied.

FIG. 22 is an exterior view of one example of a mobile telephone terminal in which the piezoelectric type loudspeaker of the present invention is applied. A chassis 36 of the mobile telephone terminal, a display 37, a piezoelectric type loudspeaker 38 of the present invention, and a sound hole 39 are shown in FIG. 22. An enlarged view (schematic illustration) of the piezoelectric type loudspeaker 38 of the present invention is shown in FIG. 22.

As shown in FIG. 22, the piezoelectric type loudspeaker 38 of the present invention is installed on the back surface of the display 37. A sound generated from the piezoelectric type loudspeaker 38 radiates out toward a space outside through the sound hole 39. Here, as described in the first to seventh embodiments, the piezoelectric type loudspeaker 38 of the present invention can attain both space-saving and high sound quality without increasing the number of parts. Thus, according to the present invention, a mobile telephone terminal that achieves both a reduction in thickness and high sound quality can be easily designed.

Second Example of Application

Figure 23:
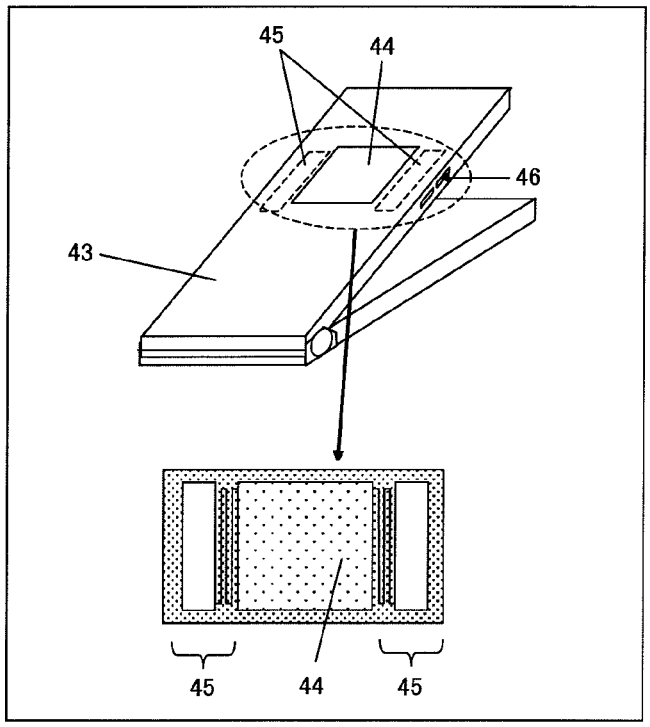
FIG. 23 is another example of an exterior view of a mobile telephone terminal in which the piezoelectric type loudspeaker of the present invention is applied.

FIG. 23 is an exterior view of another example of a mobile telephone terminal in which the piezoelectric type loudspeaker of the present invention is applied. A chassis 43 of the mobile telephone terminal, a sub-display 44, a piezoelectric type loudspeaker 45 of the present invention, and a sound hole 46 are shown in FIG. 23.

As shown in FIG. 23, the piezoelectric type loudspeaker 45 of the present invention and the sub-display 44 can be formed on the same substrate. Thus, according to the present invention, a mobile telephone terminal that achieves both a reduction in thickness and high sound quality can be easily designed, and in addition, manufacturing cost can be suppressed.

Third Example of Application

Figure 24:
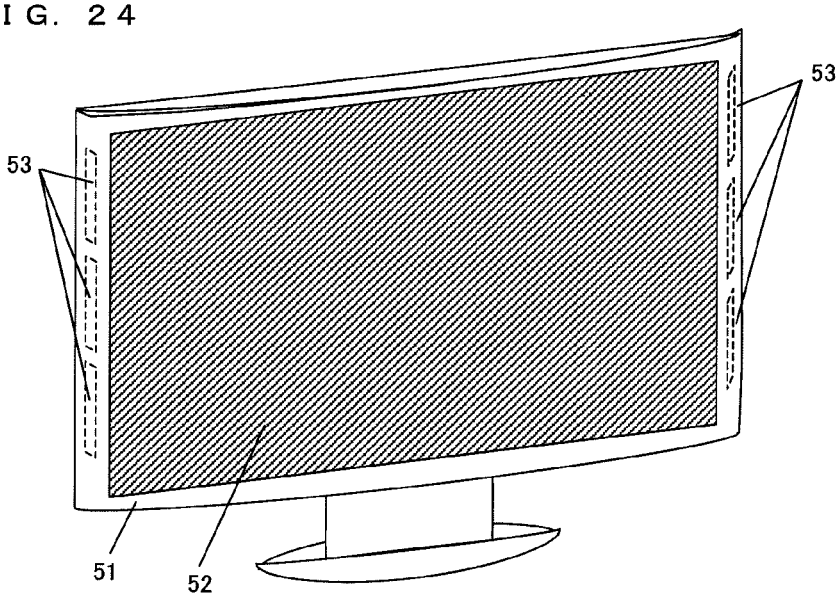
FIG. 24 is one example of an exterior view of a thin-screen television in which the piezoelectric type loudspeaker of the present invention is applied.
Figure 25:
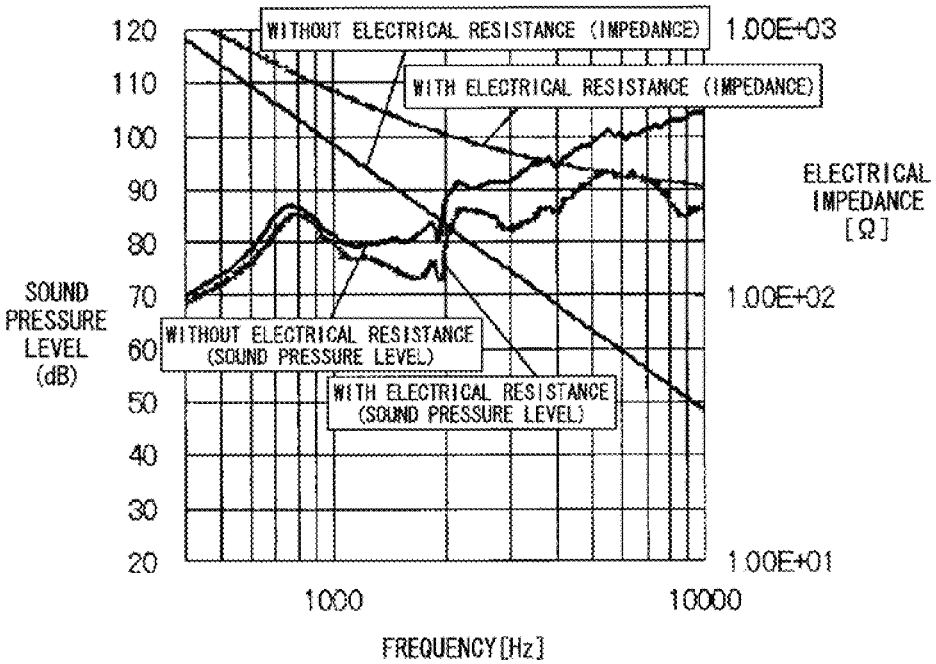
FIG. 25 PRIOR ART
FIG. 25 is a figure with measurement data showing a sound pressure suppressing effect at a high frequency range when an electrical resistance is connected to a piezoelectric element in series with a bimorph type piezoelectric loudspeaker.
Figure 26:
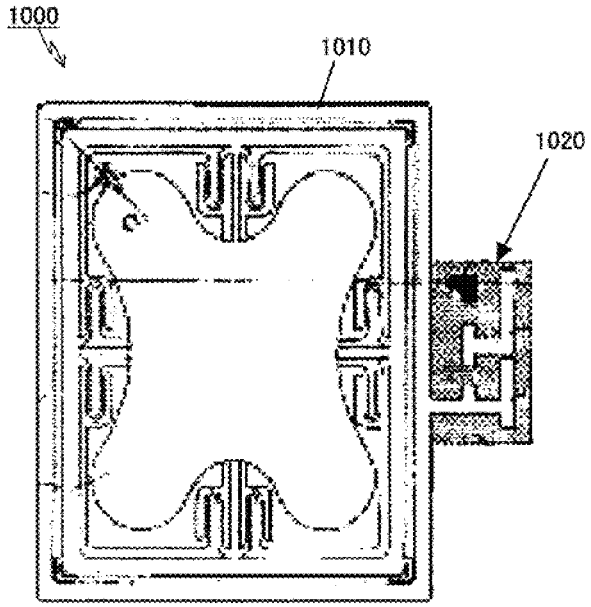
FIG. 26 PRIOR ART
FIG. 26 is a figure showing a conventional piezoelectric type loudspeaker 1000.

FIG. 24 is an exterior view of one example of a thin-screen television in which the piezoelectric type loudspeaker of the present invention is applied. A chassis 51, a display 52, and a piezoelectric type loudspeaker 53 of the present invention are shown in FIG. 24. As shown in FIG. 24, the chassis 51 of the thin-screen television generally has a shape where a thickness becomes gradually smaller from the central section toward both the right and the left ends; therefore mounting areas for a loudspeaker is very small at these ends. Here, as described in the first to seventh embodiments, the piezoelectric type loudspeaker 53 of the present invention can attain both space-saving and high sound quality without increasing the number of parts. Thus, according to the present invention, a thin-screen television that achieves both a reduction in thickness and high sound quality can be easily designed.

In the embodiments described above, the described examples are examples where the present invention is applied to a piezoelectric type loudspeaker which is one type of a piezoelectric type transducer. However, the present invention may be applied to other types of piezoelectric type transducers; for example, it may be applied to a vibrator, a sensor, or a microphone.

INDUSTRIAL APPLICABILITY

The present invention is applicable to a piezoelectric acoustic transducer and the like, and particularly useful when achieving both space-saving and high sound quality is desired.

The invention claimed is:

1. A piezoelectric acoustic transducer for producing sounds by using a piezoelectric material which deforms depending on an applied voltage, the piezoelectric acoustic transducer comprising:

a first piezoelectric material;

a first electrode material fixed and attached on an upper surface of the first piezoelectric material, the first electrode material continuously extending to a part of a lower surface of the first piezoelectric material;

a second electrode material fixed and attached at least on the lower surface of the first piezoelectric material;

a diaphragm;

a third electrode material fixed and attached on an upper surface of the diaphragm; and a fourth electrode material fixed and attached on the upper surface of the diaphragm, wherein one of the third electrode material and the fourth electrode material has a portion that is an electrical resistance, the first electrode material and the third electrode material are in contact with each other, the second electrode material and the fourth electrode material are in contact with each other, the first electrode material and the second electrode material have a function as a capacitor by a voltage being applied therebetween, and the electrical resistance and the capacitor form a series-RC circuit.

2. The piezoelectric acoustic transducer according to claim 1, wherein the first electrode material and the second electrode material function as a plurality of capacitors parallelly connected, by at least one of the first electrode material and the second electrode material being split, and the electrical resistance forms at least one series-RC circuit in combination with at least one of the plurality of capacitors.

3. The piezoelectric acoustic transducer according to claim 2, wherein at least one vibrational mode specific to the diaphragm is cancelled by having a voltage with reverse polarity applied to at least one of the plurality of capacitors.

4. The piezoelectric acoustic transducer according to claim 2, wherein the at least one series-RC circuit forms an electrical equalizer.

5. The piezoelectric acoustic transducer according to claim 2, wherein the at least one series-RC circuit is configured such that frequency ranges of sounds produced in each area of the diaphragm are different from each other.

6. The piezoelectric acoustic transducer according to claim 1, wherein the upper surface and the lower surface of the diaphragm have a part on which an electrode is absent.

7. The piezoelectric acoustic transducer according to claim 1, further comprising:

a frame section that includes a supporting section that can vibrate the diaphragm; and a highly flexible filler that fills gaps among the frame section and a vibrating section.

8. The piezoelectric acoustic transducer according to claim 1, wherein the electrical resistance is formed from either an alloy, a resin, or a composite material of a metal and a resin.

9. The piezoelectric acoustic transducer according to claim 1, wherein the electrical resistance is covered with a material having a high heat dissipating ability.

10. The piezoelectric acoustic transducer according to claim 1, wherein the electrical resistance is formed on a material having a high thermal insulation property.

11. The piezoelectric acoustic transducer according to claim 1, wherein the first piezoelectric material is a single crystal piezoelectric body, a ceramic piezoelectric body, or a high molecule piezoelectric body.

12. The piezoelectric acoustic transducer according to claim 1, wherein at least one of the first to fourth electrode materials is further integrally formed with a thin film capacitor that regulates characteristics of the series-RC circuit.

13. The piezoelectric acoustic transducer according to claim 1, wherein the electrical resistance is a material having a higher electrical resistance value than a portion other than the portion that is the electrical resistance, of the one of the third electrode material and the fourth electrode material.

14. The piezoelectric acoustic transducer according to claim 1, wherein the electrical resistance is formed as a result of having one part of the one of the third electrode material and the fourth electrode material formed in a thin line form.

15. The piezoelectric acoustic transducer according to claim 1, wherein the electrical resistance is formed as a result of having a reduced layer thickness of one part of the one of the third electrode material and the fourth electrode material.

* * * * *